US009446593B2

(12) United States Patent
Yoshida

(10) Patent No.: US 9,446,593 B2
(45) Date of Patent: Sep. 20, 2016

(54) LIQUID EJECTING HEAD HAVING A PLURALITY OF TRIBUTARY PATHS THROUGH WHICH LIQUID FLOWS AND LIQUID EJECTING APPARATUS

(71) Applicant: Seiko Epson Corporation, Tokyo (JP)

(72) Inventor: Ayumi Yoshida, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/885,217

(22) Filed: Oct. 16, 2015

(65) Prior Publication Data

US 2016/0031211 A1 Feb. 4, 2016

Related U.S. Application Data

(63) Continuation of application No. 14/656,038, filed on Mar. 12, 2015, now Pat. No. 9,186,896.

(30) Foreign Application Priority Data

Mar. 19, 2014 (JP) ..... 2014-056181

(51) Int. Cl.
*B41J 2/14* (2006.01)

(52) U.S. Cl.
CPC ..... *B41J 2/1433* (2013.01); *B41J 2/14145* (2013.01); *B41J 2/14233* (2013.01); *B41J 2002/14306* (2013.01); *B41J 2002/14362* (2013.01); *B41J 2002/14419* (2013.01); *B41J 2002/14491* (2013.01); *B41J 2202/20* (2013.01)

(58) Field of Classification Search
None
See application file for complete search history.

(56) References Cited

FOREIGN PATENT DOCUMENTS

JP 2011-088400 A 5/2011

*Primary Examiner* — Geoffrey Mruk
*Assistant Examiner* — Bradley Thies
(74) *Attorney, Agent, or Firm* — Harness, Dickey & Pierce, P.L.C.

(57) ABSTRACT

A flow-path member has a flow path to supply liquid to each head main body having nozzle openings through which liquid is ejected. The flow path of the flow-path member includes a mainstream portion and a plurality of tributary portions which branch off from the mainstream portion. Each of the plurality of tributary portions includes a vertical flow path which is connected, on an outlet port side, to a manifold portion of the head main body. Furthermore, in the vertical flow path, the cross-sectional area changes in the middle thereof. In addition, in the respective vertical flow paths, positions at which the cross-sectional areas change are different from each other.

19 Claims, 24 Drawing Sheets

LIQUID EJECTING HEAD HAVING A PLURALITY OF TRIBUTARY PATHS THROUGH WHICH LIQUID FLOWS AND LIQUID EJECTING APPARATUS

CROSS REFERENCE TO RELATED APPLICATIONS

This application is a continuation of U.S. patent application Ser. No. 14/656,038, filed on Mar. 12, 2015, which claims the benefit of Japanese Patent Application No. 2014-056181 filed on Mar. 19, 2014. The entire disclosures of the above applications are incorporated herein by reference.

BACKGROUND

1. Technical Field

The present invention relates to a liquid ejecting head in which liquid is ejected from nozzle openings and a liquid ejecting apparatus.

2. Related Art

An ink jet type recording head which includes a head main body in which a pressure generation chamber communicating with a nozzle opening through which ink droplets are discharged is deformed by a pressure generation unit, such as a piezoelectric element, in such a manner that ink droplet is discharged through the nozzle opening and a flow-path member which constitutes a flow path of ink supplied to the head main body is known as a liquid ejecting head.

In a case where a plurality of tributary flow paths which communicate, via bifurcation points, with mainstream flow paths having a common ink-supply source are provided in such an ink jet type recording head, it is necessary to set discharge properties of heads as same as possible by reducing variation in pressure losses in the tributary flow paths. Here, technique in which, when ink is supplied to a plurality of heads through supply tubes having a bifurcation function, the cross-sectional areas of the respective supply tubes change in accordance with the distances from a liquid storage unit to the respective heads has been disclosed (see JP-A-2011-88400).

However, in the configuration disclosed in JP-A-2011-88400, basically, a tube is used as the flow path. Thus, the cross-sectional area of the entirety of the flow path changes. Accordingly, a problem in relation to the connectability of the flow paths or variation in flow velocities in the respective flow paths is not considered, and thus the problem in relation to the connectability of the flow paths or variation in flow velocities in the respective flow paths cannot be solved. In addition, a problem that the size necessary for the flow path increases in accordance with an increase in the number of bifurcation portions is also not solved. Furthermore, there is no particular mention in relation to a supply pressure with respect to the mainstream flow path. In some cases, a problem that, in a tributary flow path in which the flow velocity is small, it is necessary to extremely increase, for example, the supply pressure with respect to the mainstream flow path, in order to ensure adequate air-bubble discharge properties is caused.

Such a problem is not limited to an ink jet type recording head but shared by a liquid ejecting head unit which ejects liquid other than ink.

SUMMARY

An advantage of some aspects of the invention is to provide a liquid ejecting head in which, when a plurality of tributary flow paths communicating with a mainstream flow path via bifurcation points are provided, pressure losses in the respective tributary flow paths are adjusted and which solves at least one of a problem in relation to connectability of a flow path, a problem in relation to variation in flow velocity, a problem in relation to the size necessary for a flow path, and the like and a liquid ejecting apparatus.

Aspect 1

According to an aspect of the invention, there is provided a liquid ejecting head which includes a plurality of head main bodies, each of which includes a liquid ejection surface having nozzle openings through which liquid is ejected and a flow-path member in which a flow path is provided to supply liquid to the respective head main bodies. The flow path of the flow-path member includes a mainstream portion which is connected to an inlet port that receives liquid from a liquid supply source and a plurality of tributary portions which branch off from the mainstream portion. In addition, each of the plurality of tributary portions includes a vertical flow path which extends in the vertical direction and communicates, on an outlet port side, with a manifold portion of the head main body. Furthermore, in the vertical flow path, the cross-sectional area changes in the middle thereof. In the respective vertical flow paths, the distances from the liquid ejection surface to positions at which the cross-sectional areas of the vertical flow paths change are different from each other.

In this aspect, the cross-sectional area changes in the middle of the vertical flow path, in such a manner that flow path resistance changes. Thus, the respective tributary portions can have different flow-path resistances. In addition, the lengths of the respective flow paths are appropriately set, in such a manner that, for example, variation in the pressure losses in the respective tributary portions can be reduced or the pressure losses in the respective tributary portions can be appropriately set. Furthermore, even when the number of tributary portions increases, the positions at which the cross-sectional areas of the vertical flow paths change may be appropriately set in the respective tributary portions. As a result, it is possible to reduce the radial-direction size necessary for the flow path, compared to in the case where the cross-sectional area of the entirety of the tributary portion changes.

Aspect 2

In the liquid ejecting head according to Aspect 1, it is preferable that the mainstream portion is provided extending in a horizontal direction. In addition, it is preferable that the vertical flow path includes a portion having a first cross-sectional area and a portion having a second cross-sectional area which is greater than the first cross-sectional area. Furthermore, it is preferable that, in the respective vertical flow paths, the lengths of the portions having the first cross-sectional area are different from each other. In this aspect, the mainstream portion extends in the horizontal direction. As a result, even when a plurality of tributary portions are provided, it is possible to reduce the size of the flow-path member in the vertical direction, compared to in the case where liquid is supplied through a flow path inclined with respect to the horizontal direction. Furthermore, in the respective vertical flow paths, the lengths of the portions having the first cross-sectional area are different from each other. As a result, it is easy to set the supply pressures with respect to the respective tributary portions to the same value or a desired value.

Aspect 3

In the liquid ejecting head according to Aspect 2, it is preferable that, in the tributary portions, the positions of the portions having the first cross-sectional area are the same in relation to the portions having the second cross-sectional area. In this aspect, in the tributary portions, the diameters of the outlet ports connected to the head main body can be set to the same value. As a result, it is easy to connect the tributary portions and the head main body.

Aspect 4

In the liquid ejecting head according to Aspect 3, it is preferable that the portion having the second cross-sectional area is located downstream from the portion having the first cross-sectional area. In this aspect, a portion having a large cross-sectional area is located downstream from a portion having a small cross-sectional area. As a result, it is possible to prevent dragging of air bubbles in a connection portion between the portion having the first cross-sectional area and the portion having the second cross-sectional area. Furthermore, the flow velocity in the portion having the first cross-sectional area can be set to be faster than that of the portion having the second cross-sectional area. As a result, it is possible to prevent air bubbles from remaining in a flow path extending to the vertical flow path.

Aspect 5

In the liquid ejecting head according to Aspects 1 to 4, it is preferable that, in the vertical flow path, a portion in which the cross-sectional area changes has a tapered shape. In this aspect, it is possible to prevent air bubbles from remaining in the connection portion between the portion having the first cross-sectional area and the portion having the second cross-sectional area.

Aspect 6

In the liquid ejecting head according to Aspects 1 to 5, it is preferable that the mainstream portion is formed in a two-stage shape in a vertical direction. In addition, it is preferable that supply pressures are the same in two groups of the tributary portions which are connected to a common head main body and branch off from the mainstream portion having a two-stage shape in the vertical direction. In this aspect, even when the mainstream portion are formed in a two-stage shape, supply pressures with respect to two-stage-shaped tributary portions connected to a common head main body can be set to the same value.

Aspect 7

In the liquid ejecting head according to Aspects 1 to 6, it is preferable that a wiring substrate connected to the head main body is provided in a portion between adjacent tributary portions of the plurality of tributary portions. In this aspect, the size of the liquid ejecting head can be reduced by arranging the wiring substrate in a space between adjacent tributary portions.

Aspect 8

In the liquid ejecting head according to Aspects 1 to 7, it is preferable that the liquid ejecting head further includes a common outlet-port forming member which forms the outlet ports of the plurality of tributary portions. In this aspect, the outlet-port forming member shared in common to the plurality of head main bodies are provided. Thus, it is easy to fix the flow-path forming member to the plurality of head main bodies, compared to in the case where outlet-port forming members are separately provided corresponding to the respective head main bodies having the manifolds. As a result, connectability between the head main body and the vertical flow path is improved.

Aspect 9

In the liquid ejecting head according to Aspects 1 to 8, it is preferable that the flow-path member which forms the plurality of tributary portions includes a common vertical-flow-path forming member. In addition, it is preferable that the vertical flow path of which the cross-sectional area changes in the middle thereof is formed in the vertical-flow-path forming member. In this aspect, a vertical-flow-path forming member shared in common to the plurality of vertical flow paths is provided. As a result, the number of parts can be reduced, compared to in the case where vertical-flow-path forming members are separately provided corresponding to the vertical flow paths.

Aspect 10

In the liquid ejecting head according to Aspects 1 to 9, it is preferable that the diameters of the outlet ports of the plurality of tributary portions are the same. In this aspect, the diameters of the outlet ports are the same. As a result, in each head main body, the flow velocities in the outlet ports can be uniformized. Furthermore, in each head main body, the diameters of head-main-body-side ports connected to the outlet ports are the same. As a result, it is easy to assemble the liquid ejecting head.

Aspect 11

In the liquid ejecting head according to Aspects 1 to 10, it is preferable that the minimum value of the cross-sectional areas of the plurality of tributary portions are smaller than that of the mainstream portion. In this aspect, the flow velocity in the tributary can be increased. As a result, it is possible to improve air-bubble discharge properties in the tributary portion. Furthermore, since the cross-sectional area of the mainstream portion is relatively large, the pressure loss in the mainstream portion is reduced. As a result, it is possible to reduce variation in the pressure losses in the tributary portions.

Aspect 12

In the liquid ejecting head according to Aspects 1 to 11, it is preferable that the cross-sectional area of the outlet port of each of the plurality of the tributary portions is smaller than the maximum value of the cross-sectional area of the mainstream portion and is greater than the minimum value of the cross-sectional area of each tributary portion. In this aspect, in the plurality of tributary portions, the cross-sectional areas of the outlet ports of the tributary portions satisfy such a relationship. As a result, it is possible to reduce variation in the flow velocities in the tributary portions, compared to in the case where such a relationship is not satisfied. Furthermore, in each head main body, the diameters of the head-main-body-side ports connected to the outlet ports can be set to the same value. As a result, it is easy to assemble the liquid ejecting head.

Aspect 13

In the liquid ejecting head according to Aspects 1 to 12, it is preferable that the tributary portion includes a bifurcation flow path which is provided in a portion between the mainstream portion and the vertical flow path, is connected to the mainstream portion and the vertical flow path, and allows liquid to flow in a direction intersecting the mainstream portion. In addition, it is preferable that the bifurcation flow path has an intersection portion which has a surface intersecting the intersecting direction and causes the cross-sectional area of the bifurcation flow path to be gradually reduced as the bifurcation flow path extends to the vertical flow path. In this aspect, since the bifurcation flow path includes the intersection portion, the cross-sectional area of the flow path of the intersection portion is gradually reduced. As a result, it is possible to reduce the pressure loss in a part of the bifurcation flow path, which is the portion extending to the intersection portion. In addition, the flow velocity in the intersection portion is increased, and thus it is possible to prevent air bubble from remaining on an upper side of a connection portion between the bifurcation flow path and the vertical flow path.

Aspect 14

According to another aspect, there is provided a liquid ejecting apparatus which includes the liquid ejecting head according to any one of Aspects 1 to 13.

In this aspect, it is possible to provide a liquid ejecting apparatus including a liquid ejecting head having the following configuration. In the configuration, the cross-sectional area changes in the middle of the vertical flow path, in such a manner that flow path resistance changes. As a result, the respective tributary portions can have different flow path resistances. In addition, the lengths of the respective flow paths are appropriately set, in such a manner that, for example, variation in the pressure losses in the respective tributary portions is reduced or the pressure losses in the respective tributary portions are appropriately set.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, details of embodiments of the invention will be described.

Embodiment 1

Figure 1:
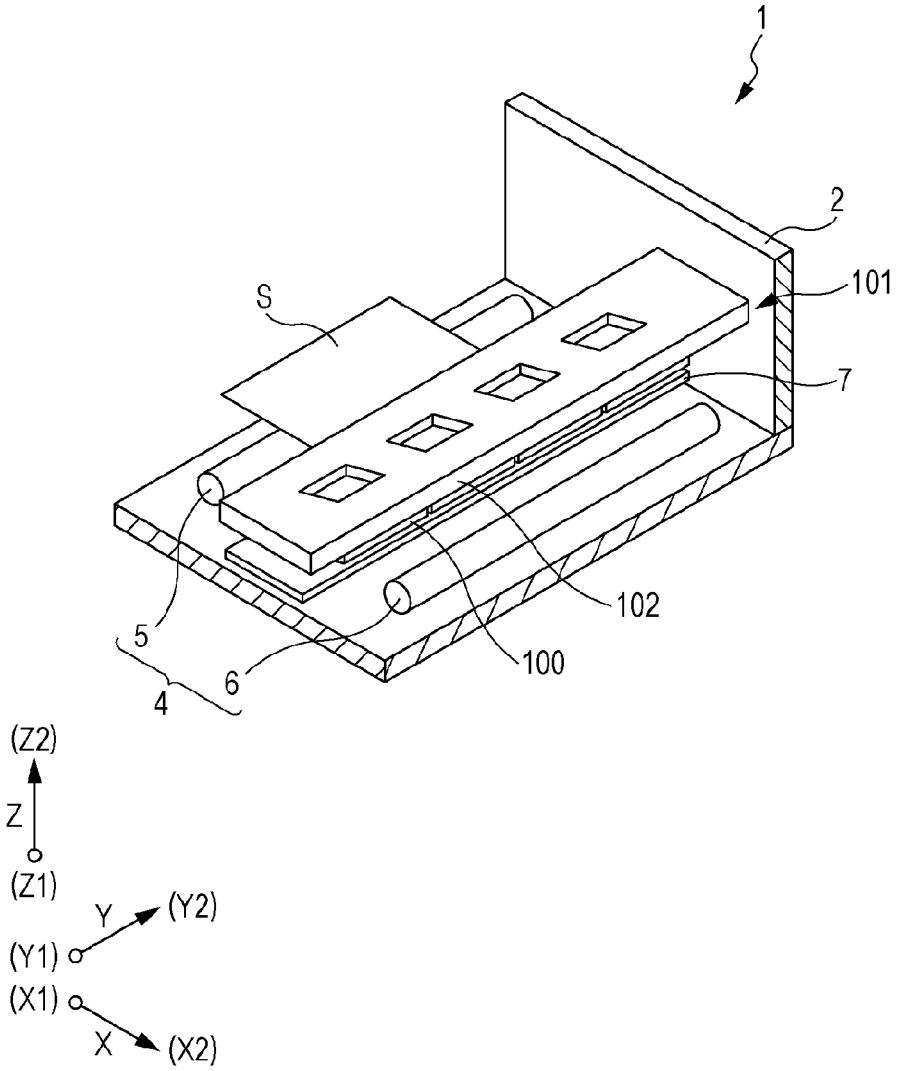
FIG. 1 is a schematic perspective view of a recording apparatus according to Embodiment 1 of the invention.

Details of embodiments of the invention will be described. An ink jet type recording head is an example of a liquid ejecting head and also referred to simply as a recording head. An ink jet type recording unit is an example of a liquid ejecting head unit and also referred to simply as a head unit. An ink jet type recording apparatus is an example of a liquid ejecting apparatus. FIG. 1 is a perspective view illustrating the schematic configuration of an ink jet type recording apparatus according to this embodiment.

An ink jet type recording apparatus 1 is a so-called line type recording apparatus, as illustrated in FIG. 1. The ink jet type recording apparatus 1 includes a head unit 101. In the ink jet type recording apparatus 1, a recording sheet S, such as a paper sheet as an ejection target medium, is transported, in such a manner that printing is performed.

Specifically, the ink jet type recording apparatus includes an apparatus main body 2, the head unit 101, a transport unit 4, and a support member 7. The head unit 101 has a plurality of recording heads 100. The transport unit 4 transports the recording sheet S. The support member 7 supports the recording sheet S facing the head unit 101. In this embodiment, a transporting direction of the recording sheet S is set to an X direction. In a liquid ejection surface of the head unit 101, in which nozzle openings are provided, a direction perpendicular to the X direction is set to a Y direction. A direction perpendicular to both the X direction and the Y direction is set to a Z direction. In this embodiment, the Z direction is parallel to a vertical direction. In the X direction, an upstream direction in which the recording sheet S is transported is set to an X1 direction and a downstream direction is set to an X2 direction. In the Y direction, one direction is set to a Y1 direction and the other is set to a Y2 direction. In the Z direction, a direction (toward the recording sheet S) parallel to a liquid ejecting direction is set to a Z1 direction and an opposite direction is set to a Z2 direction.

The head unit 101 includes a plurality of recording heads 100 and a head fixing substrate 102 which holds a plurality of recording heads 100.

The plurality of recording heads 100 is fixed to the head fixing substrate 102, in a state where the recording heads 100 are aligned in the Y direction intersecting the X direction which is the transporting direction. In this embodiment, the plurality of recording heads 100 are aligned in a straight line extending in the Y direction. In other words, the plurality of recording heads 100 are arranged so as not to be shifted toward the X direction. Accordingly, the X-direction width of head unit 101 is reduced, and thus it is possible to reduce the size of the head unit 101.

The head fixing substrate 102 holds the plurality of recording heads 100, in a state where the nozzle openings of the plurality of recording heads 100 are directed toward the recording sheet S. The head fixing substrate 102 holds a plurality of the recording heads 100 and is fixed to the apparatus main body 2.

The transport unit 4 transports the recording sheet S in the X direction, with respect to the head unit 101. The transport unit 4 includes a first transport roller 5 and a second transport roller 6 which are provided, in relation with the head unit 101, for example, on both sides in the X direction as the transporting direction of the recording sheet S. The recording sheet S is transported, in the X direction, by the first transport roller 5 and the second transport roller 6. The transport unit 4 for transporting the recording sheet S is not limited to a transport roller. The transport unit 4 may be constituted of a belt, a drum, or the like.

The support member 7 supports the recording sheet S transported by the transport unit 4, at a position facing the head unit 101. The support member 7 is constituted of, for example, a metal member or a resin member of which the cross-sectional surface has a rectangular shape. The support member 7 is disposed in an area between the first transport roller 5 and the second transport roller 6, in a state where the support member 7 faces the head unit 101.

An adhesion unit which is provided in the support member 7 and causes the recording sheet S to adhere thereto may be provided in the support member 7. Examples of the adhesion unit include a unit which causes the recording sheet S to adhere thereto by sucking up the recording sheet S and a unit which causes the recording sheet S to be adhered thereto by electrostatically attracting the recording sheet S using electrostatic force. Furthermore, when the transport unit 4 is constituted of a belt or a drum, the support member 7 is located at a position facing the head unit 101 and causes the recording sheet S to be supported on the belt or the drum.

Although not illustrated, a liquid storage unit, such as an ink tank and an ink cartridge in which ink is stored, is connected to each recording head 100 of the head unit 101, in a state where the liquid storage unit can supply ink to the recording head 100. The liquid storage unit may be held on, for example, the head unit 101. Alternatively, in the apparatus main body 2, the liquid storage unit is held at a position separate from the head unit 101. A flow path and the like through which the ink supplied from the liquid storage unit is supplied to the recording head 100 may be provided in the inner portion of the head fixing substrate 102. Alternatively, an ink flow-path may be provided in the head fixing substrate 102 and ink from the liquid storage unit may be supplied to the recording head 100 through the ink flow-path member. Needless to say, ink may be directly supplied from the liquid storage unit to the recording head 100, without passing through the head fixing substrate 102 or the ink flow-path member fixed to the head fixing substrate 102.

In such an ink jet type recording apparatus 1, the recording sheet S is transported, in the X direction, by the first transport roller 5, and then the head unit 101 performs printing on the recording sheet S supported on the support member 7. The recording sheet S subjected to printing is transported, in the X direction, by the second transport roller 6.

Figure 2:
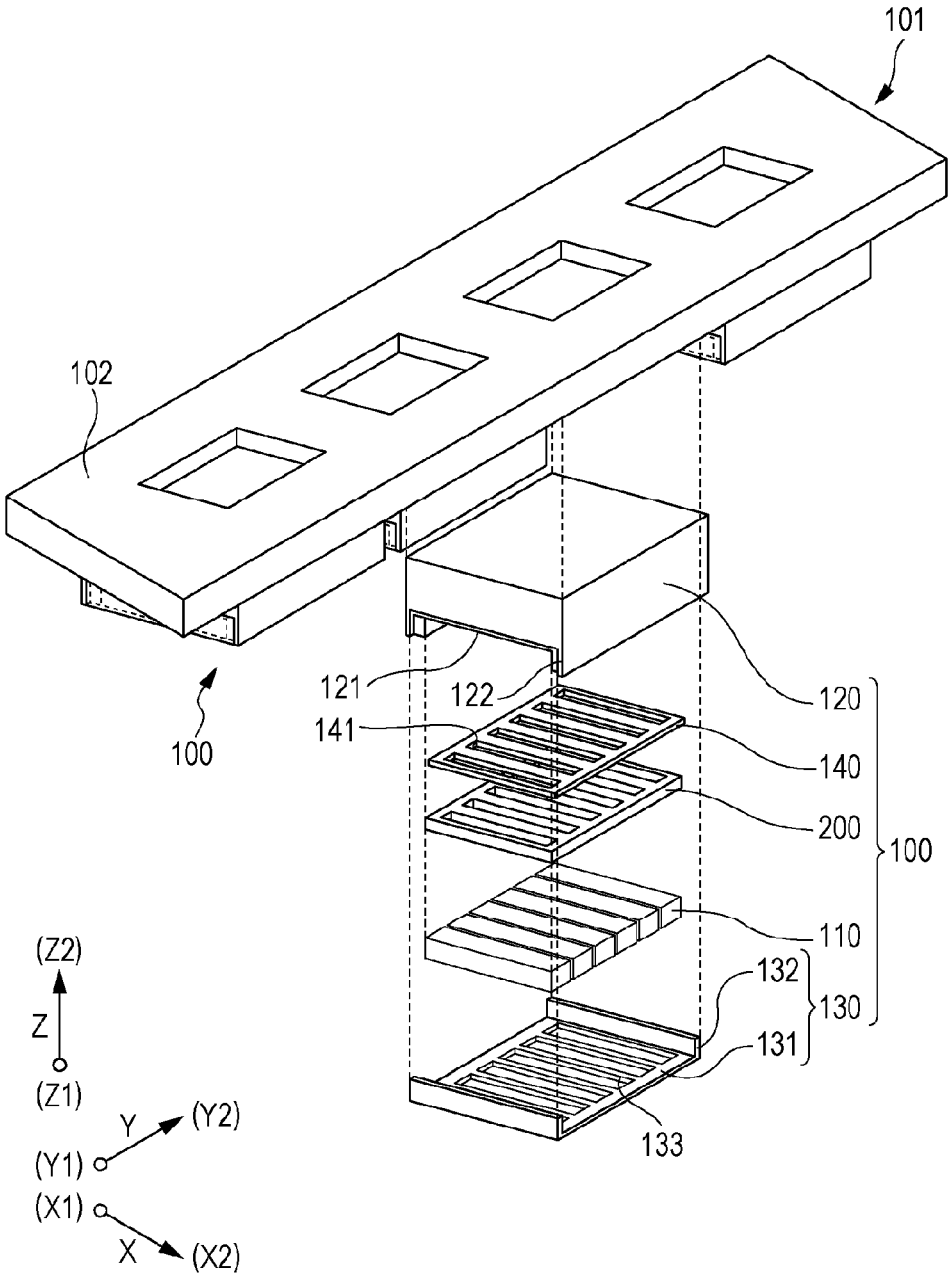
FIG. 2 is an exploded perspective view of a head unit according to Embodiment 1 of the invention.
Figure 3:
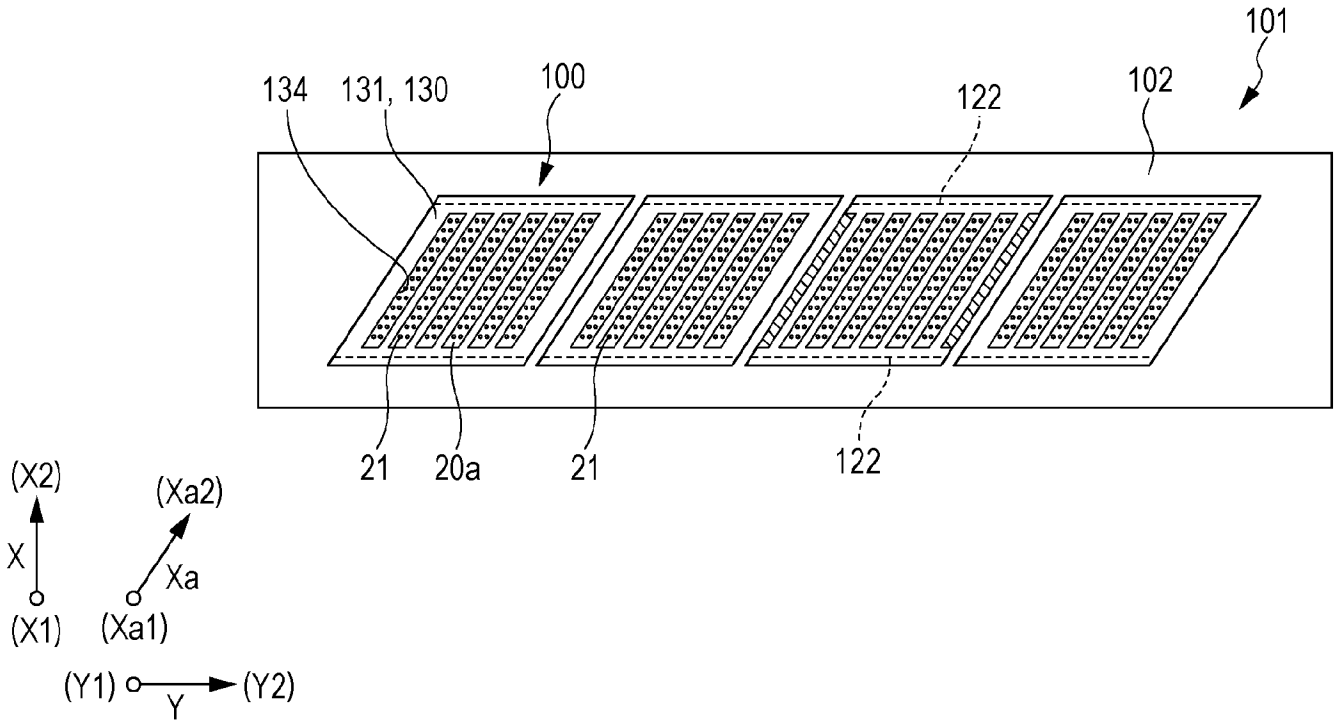
FIG. 3 is a bottom view of the head unit according to Embodiment 1 of the invention.

Details of the head unit 101 will be described with reference to FIGS. 2 and 3. FIG. 2 is an exploded perspective view illustrating the head unit according to this embodiment and FIG. 3 is a bottom view of the head unit, when viewed from the liquid ejection surface side.

The head unit 101 of this embodiment includes a plurality of recording heads 100 and the head fixing substrate 102 which holds the plurality of recording heads 100. In the recording head 100, a liquid ejection surface 20*a* in which the nozzle openings 21 are formed is provided on the Z1 side in the Z direction. Each recording head 100 is fixed to a surface of the head fixing substrate 102, which is the surface facing the recording sheet S. In other words, the recording head 100 is fixed to the Z1 side, that is, the side facing the recording sheet S, of the head fixing substrate 102 in the Z direction.

As described above, the plurality of recording heads 100 are fixed to the head fixing substrate 102, in a state where the recording heads 100 are aligned on a straight line extending in the Y direction perpendicular to the X direction which is the transporting direction. In other words, the plurality of recording heads 100 are arranged so as not to be shifted toward the X direction. Accordingly, the X-direction width of the head unit 101 is reduced, and thus it is possible to reduce the size of the head unit 101. Needless to say, the recording heads 100 aligned in the Y direction may be arranged to be shifted toward the X direction. However, in this case, when the recording heads 100 are greatly shifted toward the X direction, for example, the X-direction width of the head fixing substrate 102 increases. When the X-direction size of the head unit 101 increases, as described above, the X-direction distance between the first transport roller 5 and the second transport roller 6 increases in the ink jet type recording apparatus 1. As a result, it is difficult to fix the posture of the recording sheet S. In addition, the size of the head unit 101 and the ink jet type recording apparatus 1 increases.

In this embodiment, four recording heads 100 are fixed to the head fixing substrate 102. However, the configuration is not limited thereto, as long as the number of recording heads 100 is two or more.

Figure 4:
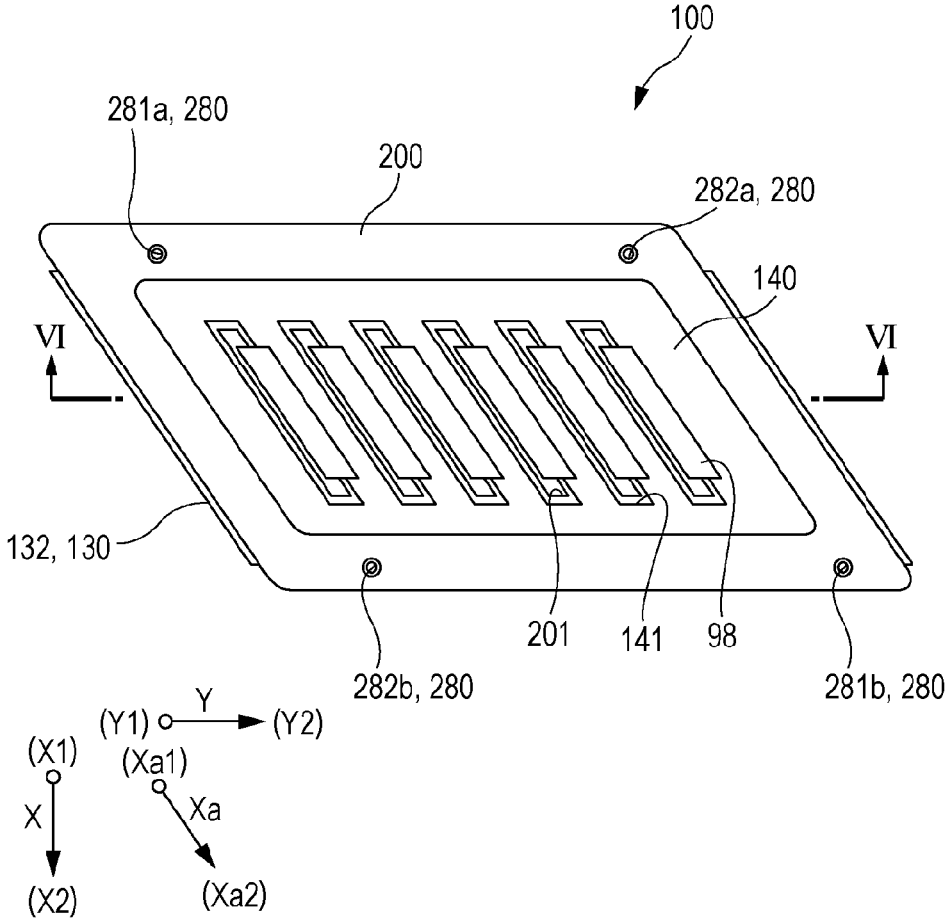
FIG. 4 is a plan view of a recording head according to Embodiment 1 of the invention.
Figure 5:
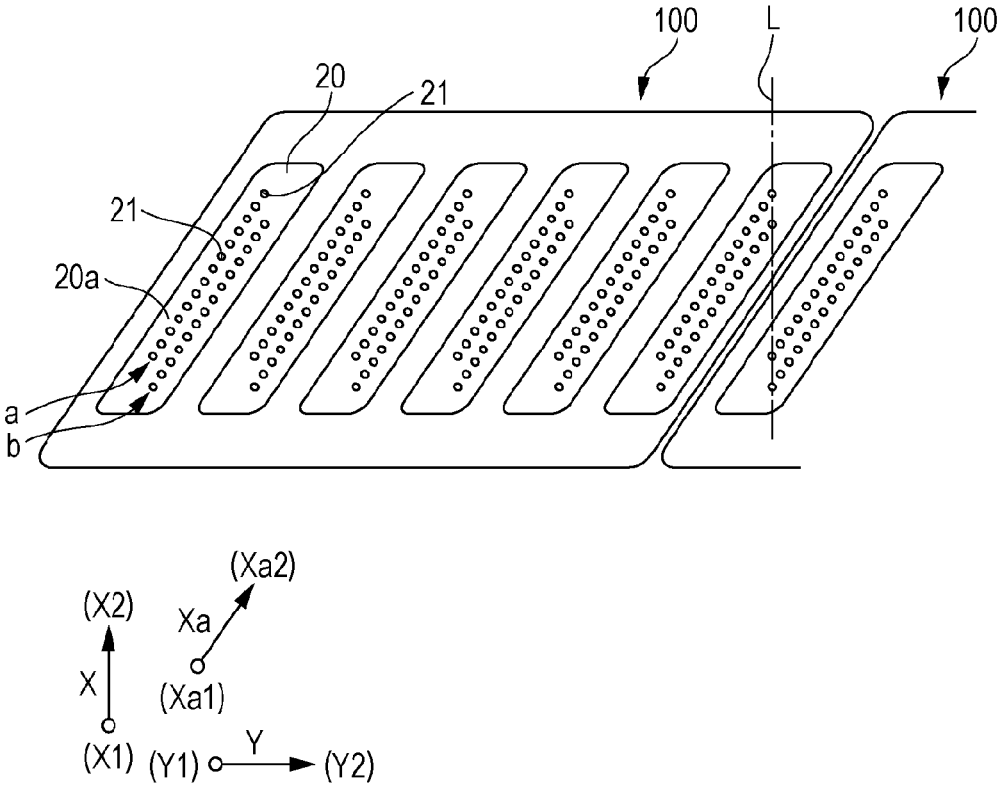
FIG. 5 is a bottom view of the recording head according to Embodiment 1 of the invention.
Figure 6:
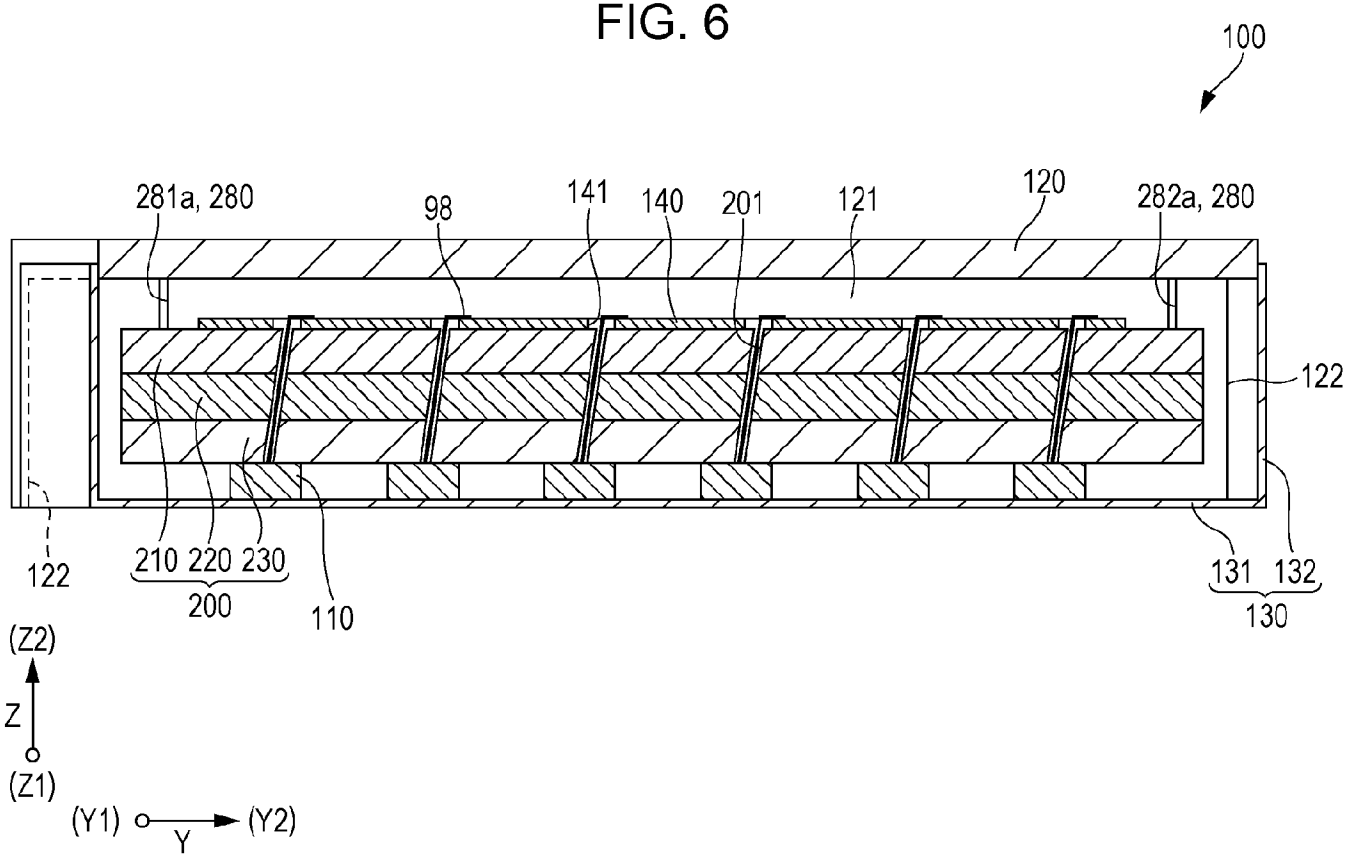
FIG. 6 is a cross-sectional view of FIG. 4, taken along a line VI-VI.

Next, the recording head 100 will be described with reference to FIG. 2 and FIGS. 4 to 6. FIG. 4 is a plan view of the recording head and FIG. 5 is a bottom view of the recording head. FIG. 6 is a cross-sectional view of FIG. 4, taken along a line VI-VI. FIG. 4 is a plan view of the recording head 100, when viewed from the Z2 side in the Z direction. A holding member 120 is not illustrated in FIG. 4.

The recording head 100 includes the plurality of head main bodies 110, COF substrates 98, and a flow-path member 200. The COF substrates 98 are respectively connected to the head main bodies 110. Flow paths through which ink is supplied to respective head main bodies are provided in the flow-path member 200. Furthermore, in this embodiment, the recording head 100 includes the holding member 120, a fixing plate 130, and a relay substrate 140. The holding member 120 holds the plurality of head main bodies 110. The fixing plate 130 is provided on the liquid ejection surface 20*a* side of the head main body 110.

The head main body 110 receives ink from the holding member 120 and the flow-path member 200 in which ink flow paths are provided. Control signals are transmitted from a controller (not illustrated) in the ink jet type recording apparatus 1 to the head main body 110, via both the relay substrate 140 and the COF substrate 98 and the head main body 110 discharges ink droplets in accordance with the control signals. Details of the configuration of the head main body 110 will be described below.

In each head main body 110, the liquid ejection surface 20*a* in which nozzle openings 21 are formed is provided on the Z1 side in the Z direction. Z2 sides of the plurality of head main bodies 110 adhere to the Z1-side surface of the flow-path member 200.

Liquid flow paths of ink supplied to the head main body 110 are provided in the flow-path member 200. The plurality of head main bodies 110 adhere to the Z1-side surface of the flow-path member 200, in a state where the plurality of head main bodies 110 are aligned in the Y direction. Details of the configuration of the flow-path member 200 will be described below. The liquid flow paths in the flow-path member 200 communicate with liquid flow paths of the respective head main bodies 110, in such a manner that ink is supplied from the flow-path member 200 to the respective head main bodies 110.

In this embodiment, six head main bodies 110 adhere to one flow-path member 200. However, the number of head main bodies 110 fixed to one flow-path member 200 is not limited to six. One head main body 110 may be fixed to each flow-path member 200 or two or more head main bodies 110 may be fixed to each flow-path member 200.

An opening portion 201 is provided in the flow-path member 200, in a state where the opening portion 201 passes through the flow-path member 200 in the Z direction. The COF substrate 98 of which one end is connected to the head main body 110 is inserted through the opening portion 201.

The COF substrate 98 is an example of a flexible wiring substrate. A flexible wiring substrate is a flexible substrate having wiring formed thereon. Furthermore, the COF substrate 98 includes a driving circuit 97 (see FIG. 7) which drives a pressure generation unit in the head main body 110.

The relay substrate 140 is a substrate on which electrical components, such as wiring, an IC, and a resistor, are mounted. The relay substrate 140 is disposed in a portion between the holding member 120 and the flow-path member 200. A passing-through portion 141 communicating with the opening portion 201 in the flow-path member 200 is formed in the relay substrate 140. The size of the opening of each passing-through portion 141 is greater than that of the opening portion 201 of the flow-path member 200.

The COF substrate 98 connected to the pressure generation unit of the head main body 110 is inserted through both the opening portion 201 and the passing-through portion 141. The COF substrate 98 is connected to a terminal (not illustrated) in the Z2-side surface of the relay substrate 140. In other words, the COF substrates 98 are respectively connected to the head main bodies 110. The COF substrate 98 extends from the Z1 side to the Z2 side in the Z direction. Furthermore, when viewed from the Y direction, all of the COF substrates 98 connected to the plurality of head main bodies 110 overlap each other. Although the COF substrate 98 of this embodiment is inclined, the lead electrode 90 and the relay substrate 140 which are electrically connected to the COF substrate 98 are arranged apart from each other in the Z direction, as described below. Thus the meaning of "the COF substrate 98 extends in the Z direction" includes the case in which the COF substrate 98 is inclined, as described above.

Although not particularly illustrated, the relay substrate 140 is connected to the controller of the ink jet type recording apparatus 1. Accordingly, for example, the driving signals sent from the controller are transmitted, through the relay substrate 140, to the driving circuit 97 of the COF substrate 98. The pressure generation unit of the head main body 110 is driven by the driving circuit 97. Therefore, an ink ejection operation of the recording head 100 is controlled.

On the Z1 side of the holding member 120, a hold portion 121 is provided to form a space having a groove shape. On the Z1-side surface of the holding member 120, the hold portion 121 continuously extends in the Y direction, and thus the hold portion 121 is open to both side surfaces of the holding member 120 in the Y direction. Furthermore, the hold portion 121 is provided in a substantially central portion of the holding member 120 in the X direction, and thus leg portions 122 are formed on both sides of the hold portion 121 in the X direction. In other words, in the Z1-side surface of the holding member 120, the leg portions 122 are provided on only both end portions in the X direction and are not provided on both end portions in the Y direction. In this embodiment, the holding member 120 is constituted of one member. However, the configuration of the holding member 120 is not limited thereto. The holding member 120 may be constituted of a plurality of members stacked in the Z direction.

The relay substrate 140, the flow-path member 200, and the plurality of head main body 110 are accommodated in such a hold portion 121. Specifically, the respective head main bodies 110 are bonded to the Z1-side surface of the flow-path member 200, using, for example, an adhesive. Furthermore, the relay substrate 140 is fixed to the Z2-side surface of the flow-path member 200. The relay substrate 140, the flow-path member 200, and the plurality of head main bodies 110 which are bonded into a single member are accommodated in the hold portion 121.

In the holding member 120 and the flow-path member 200, the Z-direction facing surfaces of the hold portion 121 and the flow-path member 200 adhere to each other, using an adhesive. The relay substrate 140 is accommodated in a space between the hold portion 121 and the flow-path member 200. The holding member 120 and the flow-path member 200 may be integrally fixed using a fixing unit, such as a screw, instead of using an adhesive.

Although not particularly illustrated, a flow path through which ink flows, a filter which filters out, for example, foreign matter, and the like may be provided in the holding member 120. The flow path of the holding member 120 communicates with the liquid flow path of the flow-path member 200. Accordingly, the ink fed from the liquid storage unit in the ink jet type recording apparatus 1 is supplied to the head main body 110 via both the holding member 120 and the flow-path member 200.

The fixing plate 130 is provided on the liquid ejection surface 20*a* side of the recording head 100. In other words, the fixing plate 130 is provided on the Z1 side of the recording head 100 in the Z direction and holds the respective recording heads 100. The fixing plate 130 is formed by bending a plate-shaped member constituted of, for example, metal. Specifically, the fixing plate 130 includes a base portion 131 and bent portions 132. The base portion 131 is provided on the liquid ejection surface 20*a* side of the fixing plate 130. Both end portions of the base portion 131 in the Y direction are bent in the Z2 direction, in such a manner that the bent portions 132 are formed.

Exposure opening portions 133 are provided in the base portion 131. The exposure opening portions 133 are openings for exposing the nozzle openings 21 of the respective head main bodies 110. In this embodiment, the exposure opening portions 133 are open in a state where the exposure opening portions 133 separately respectively correspond to the head main bodies 110. In other words, the recording head 100 of this embodiment has the six head main bodies 110, and thus six separate exposure opening portions 133 are provided in the base portion 131. Needless to say, one common exposure opening portion 133 may be provided with respect to a head main body group constituted of a plurality of head main bodies 110, in accordance with, for example, the configuration of the head main body 110.

The Z1 side of the hold portion 121 of the holding member 120 is covered with such a base portion 131. The base portion 131 is bonded, using an adhesive, to the Z1-side surface of the holding member 120 in the Z direction, in other words, the Z1-side end surfaces of the leg portion 122, as illustrated in FIG. 6.

The bent portions 132 are provided on both end portions of the base portion 131 in the Y direction. The bent portions 132 have a size which is capable of covering the opening areas of the hold portion 121, which are open in the Y-direction side surfaces of the hold portion 121. In other words, the bent portion 132 is a portion extending from the Y-direction end portion of the base portion 131 to the edge portion of the fixing plate 130. In addition, such a bent portion 132 is bonded, using an adhesive, to the Y-direction side surface of the holding member 120. Accordingly, the openings of the hold portion 121, which are open in the Y-direction side surfaces of the hold portion 121, are covered and sealed with the bent portions 132.

The fixing plate 130 adheres, using an adhesive, to the holding member 120, as described above, and thus the head main body 110 is disposed in the inner portion of the hold portion 121, which is a space between the holding member 120 and the fixing plate 130.

The plurality of head main bodies 110 are provided in each recording head 100, in such a manner that the recording head 100 of this embodiment has a plurality of nozzle rows, as described above. In this case, it is possible to improve a yield, compared to in a case where a plurality of nozzle rows are provided in only one head main body 110, in such a manner that one recording head 100 has a plurality of nozzle rows. In other words, when a plurality of nozzle rows are provided by one head main body 110, the yield of the head main body 110 decreases and a manufacturing cost increases. In contrast, when a plurality of nozzle rows are provided by a plurality of head main bodies 110, the yield of the head main body 110 is improved and the manufacturing cost can be reduced.

The openings in the Y-direction side surfaces of the holding member 120 are sealed with the bent portions 132 of the fixing plate 130. Accordingly, even when leg portions 122 which adhere to the base portion 131 of the fixing plate 130 are not provided on both sides (which are hatched portions in FIG. 3) of the holding member 120 in the Y direction, it is possible to prevent moisture evaporation from occurring through the openings in the Y-direction side surfaces of the hold portion 121.

Accordingly, in the head unit 101 in which the recording heads 100 are aligned in the Y direction, a gap between adjacent recording heads 100 in the Y direction can be reduced because the leg portions 122 are not provided on the Y-direction sides of the adjacent recording heads 100. Accordingly, the head main bodies 110 of adjacent recording heads 100 in the Y direction can be arranged close to each other, and thus the nozzle openings 21 of the respective head main bodies 110 of the adjacent recording heads 100 can be arranged close to each other in the Y direction.

In the recording head 100 according to this embodiment, the leg portions 122 are provided on both sides of the holding member 120 in the X direction. However, the leg portions 122 may not be provided. In other words, the head main body 110 may adhere to the Z1-side surface of the holding member 120 and the bent portions 132 may be provided on both sides of the fixing plate 130 in the X direction and on both sides thereof in the Y direction. That is, the bent portions 132 may be provided over the circumference of the fixing plate 130, in an in-plane direction of the liquid ejection surface 20*a*, and the fixing plate 130 adheres over the circumference of the side surfaces of the holding member 120. However, when the leg portions 122 are provided on both sides of the holding member 120 in the X direction, as in the case of this embodiment, the Z1-side end surfaces of the leg portion 122 adhere to the base portion 131 of the fixing plate 130. As a result, the hardness of the ink jet type recording head 100 in the Z direction can be improved and it is possible to prevent moisture evaporation from occurring through the leg portions 122.

Figure 7:
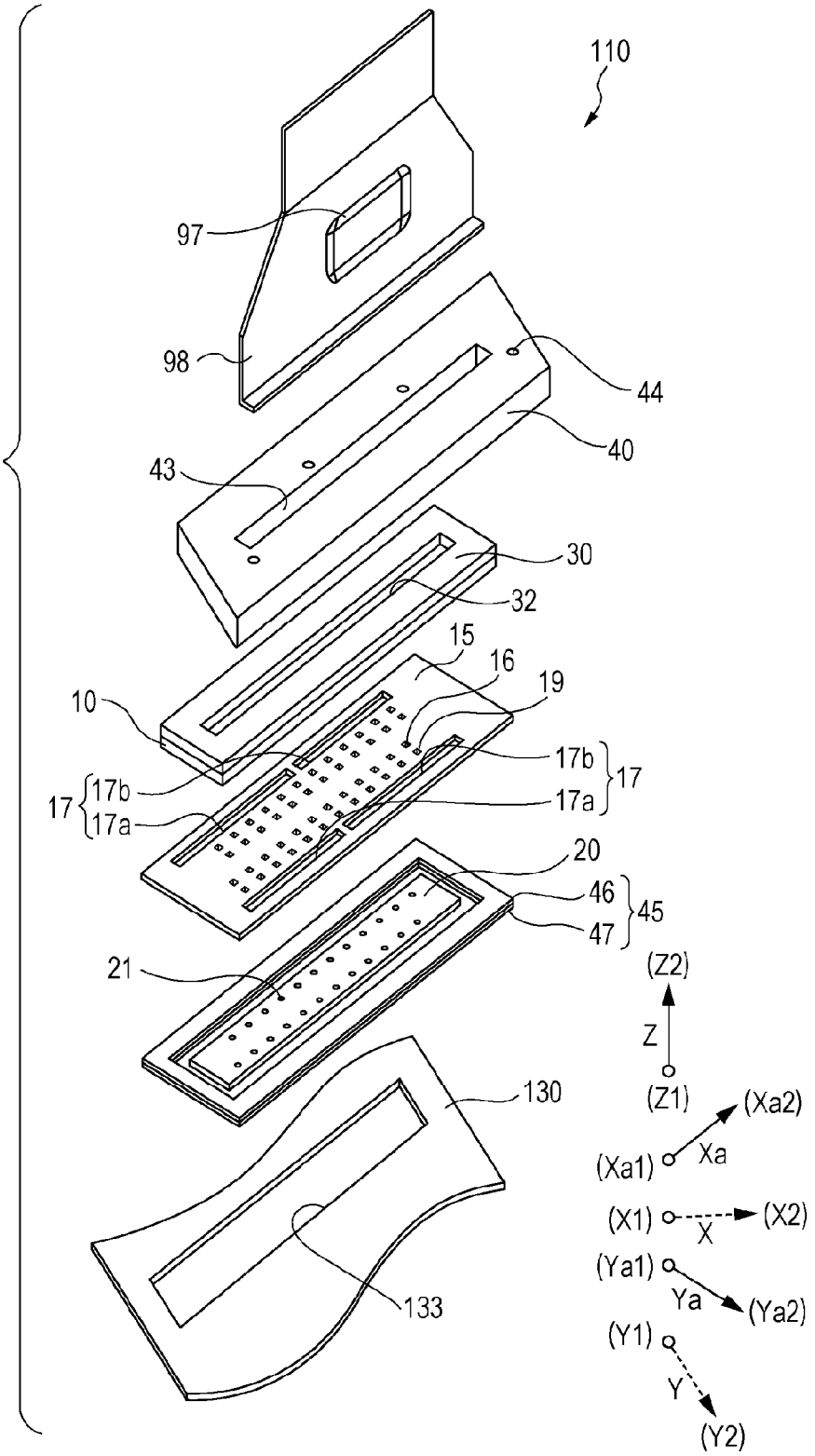
FIG. 7 is an exploded perspective view of a head main body according to Embodiment 1 of the invention.
Figure 8:
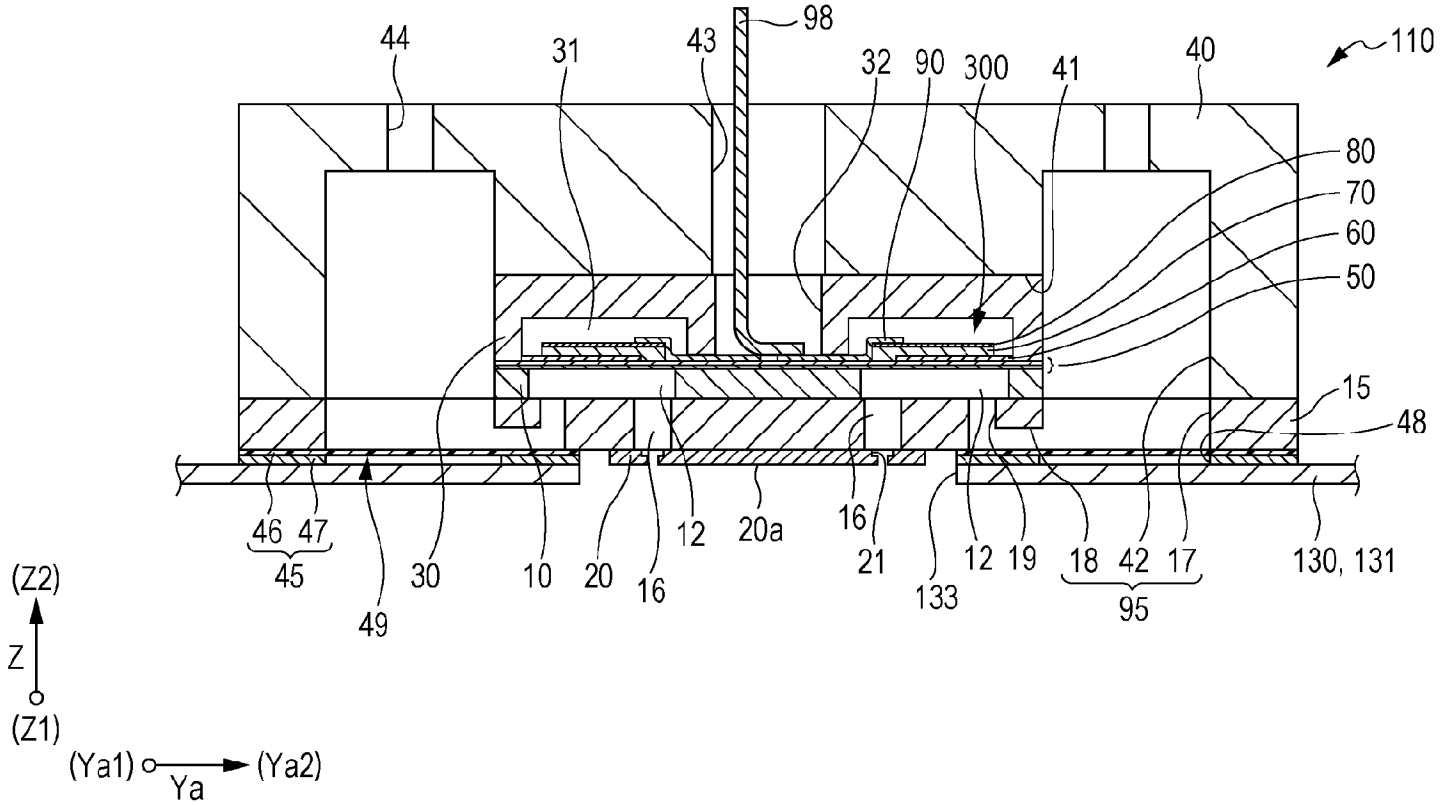
FIG. 8 is a cross-sectional view of the head main body according to Embodiment 1 of the invention.

The head main body 110 will be described with reference to FIGS. 7 and 8. FIG. 7 is a perspective view of the head main body according to this embodiment and FIG. 8 is a cross-sectional view of the head main body, taken along a line extending in the Y direction. Needless to say, the configuration of the head main body 110 is not limited to the configuration described below.

The head main body 110 of this embodiment includes a pressure generation chamber 12, the nozzle openings 21, a manifold 95, the pressure generation unit, and the like. Therefore, a plurality of members, such as a flow-path forming substrate 10, a communication plate 15, a nozzle plate 20, a protection substrate 30, a compliance substrate 45, a case 40 and the like are bonded to one another, using, for example, an adhesive.

One surface side of the flow-path forming substrate is subjected to anisotropic etching, in such a manner that a plurality of pressure generation chambers 12 partitioned by a plurality of partition walls are provided in the flow-path forming substrate 10, in a state where the pressure generation chambers 12 are aligned in an alignment direction of a plurality of the nozzle openings 21. In this embodiment, the alignment direction of the pressure generation chambers 12 is referred to as the Xa direction. Furthermore, a plurality (two, in this embodiment) of rows, each of which is constituted of the pressure generation chambers 12 aligned in the Xa direction, are provided in the flow-path forming substrate 10. A row-alignment direction in which a plurality of rows of the pressure generation chambers 12 are aligned will be referred to as a Ya direction. In this embodiment, a direction perpendicular to both the Xa direction and the Ya direction is parallel to the Z direction. Furthermore, the head main body 110 of this embodiment is mounted on the head unit 101, in a state where the Xa direction as an alignment direction of the nozzle openings 21 is inclined with respect to the X direction as the transporting direction of the recording sheet S.

For example, a supply path of which the opening area is smaller than that of the pressure generation chamber and which imparts a flow-path resistance to the ink flowing to the pressure generation chamber 12 may be provided in the flow-path forming substrate 10 in one end side of the Ya direction of the pressure generation chamber 12.

The communication plate 15 is bonded to one surface side of the flow-path forming substrate 10. Furthermore, the nozzle plate 20 in which a plurality of nozzle openings communicating with the respective pressure generation chambers 12 are provided is bonded to the communication plate 15. In this embodiment, the Z1 side of the nozzle plate 20, on which the nozzle openings 21 are open, is the liquid ejection surface 20*a*.

A nozzle communication path 16 which allows the pressure generation chamber 12 to communicate with the nozzle opening 21 is provided in the communication plate 15. The area of the communication plate 15 is greater than that of the flow-path forming substrate 10 and the area of the nozzle plate 20 is smaller than that of the flow-path forming substrate 10. The nozzle plate 20 has a relatively small area, as described above. As a result, it is possible to achieve a reduction in costs.

A first manifold 17 and a second manifold 18 which constitute a part of the manifold 95 is provided in the communication plate 15. The first manifold 17 passes through the communication plate 15 in the Z direction. The second manifold 18 does not pass through the communication plate 15 in the Z direction. The second manifold 18 is open to the nozzle plate 20 side of the communication plate 15 and extends to the Z-direction middle portion of the nozzle plate 20.

Supply communication paths 19 which communicate with respective end portions of the pressure generation chambers 12 in the Y direction is provided in the communication plate 15, in a state where the supply communication paths 19 separately respectively correspond to the pressure generation chambers 12. The supply communication path 19 allows the second manifold 18 to communicate with the pressure generation chamber 12.

The nozzle openings 21 which respectively communicate with the pressure generation chambers 12 through the nozzle communication path 16 are formed in the nozzle plate 20. The plurality of nozzle openings 21 are aligned in the Xa direction. The aligned nozzle openings 21 form two nozzle rows which are a nozzle row a and a nozzle row b. The nozzle row a and the nozzle row b are aligned in the Ya direction. In this embodiment, each of the nozzle rows a and b is divided into two portions, and thus one nozzle row can eject liquids of two kinds. Details of this will be described below.

Meanwhile, a diaphragm 50 is formed on a surface of the flow-path forming substrate 10, which is the surface on the side opposite to the communication plate 15 of the flow-path forming substrate 10. A first electrode 60, a piezoelectric layer 70, and a second electrode 80 are laminated, in order, on the diaphragm 50, in such a manner that a piezoelectric actuator 300 as the pressure generation unit of this embodiment is constituted. Generally, one electrode of the piezoelectric actuator 300 is constituted of a common electrode. The other electrodes and the piezoelectric layers are subjected to patterning such that the other electrode and the piezoelectric layer correspond to each pressure generation chamber 12.

The protection substrate 30 having substantially the same size as that of the flow-path forming substrate 10 is bonded to a surface of the flow-path forming substrate 10, which is the surface on the piezoelectric actuator 300 side. The protection substrate 30 has a hold portion 31 which is a space for protecting the piezoelectric actuator 300. Furthermore, in the protection substrate 30, a through-hole 32 is provided in a state where the through-hole 32 passes through the protection substrate 30 in the Z direction. An end portion of a lead electrode 90 extending from the electrode of the piezoelectric actuator 300 extends such that the end portion is exposed to the inner portion of the through-hole 32. The lead electrode 90 and the COF substrate 98 are electrically connected in the through-hole 32.

Furthermore, the case 40 which forms manifolds 95 communicating with a plurality of pressure generation chambers 12 is fixed to both the protection substrate 30 and the communication plate 15. In a plan view, the case 40 and the communication plate 15 described above have the substantially the same shape. The case 40 is bonded to the protection substrate 30 and, further, bonded to the communication plate 15 described above. Specifically, a concave portion 41 is provided on the protection substrate 30 side of the case 40. The depth of the concave portion 41 is enough to accommodate both the flow-path forming substrate 10 and the protection substrate 30. The opening area of the concave portion 41 is greater than that of a surface of the protection substrate 30, which is the surface bonded to the flow-path forming substrate 10. An opening surface of the concave portion 41, which is the opening surface on the nozzle plate 20 side, is sealed with the communication plate 15, in a state where the flow-path forming substrate 10 and the like are accommodated in the concave portion 41. Accordingly, in the outer circumferential portion of the flow-path forming substrate 10, a third manifold 42 is formed by the case 40, the flow-path forming substrate 10, and the protection substrate 30. The manifold 95 of this embodiment is constituted of the third manifold 42, the first manifold 17, and the second manifold 18, in which the first manifold 17 and the second manifold 18 are provided in the communication plate 15. Liquids of two kinds can be ejected by one nozzle row, as described above. Thus, each of the first manifold 17, the second manifold 18, and the third manifold 42 which constitute the manifold 95 is divided into two portions, in a nozzle-row direction, that is, the Xa direction. The first manifold 17 is constituted of, for example, a first manifold 17*a* and a first manifold 17*b*, as illustrated in FIG. 7. Similarly, each of the second manifold 18 and the third manifold 42 is also divided into two portions. Thus, the entirety of the manifold 95 is divided into two portions, in the Xa direction.

In this embodiment, the first manifolds 17, the second manifolds 18, and the third manifolds 42 which constitute the manifolds 95 are symmetrically arranged with the nozzle rows a and b interposed therebetween. In this case, the nozzle row a and the nozzle row b can eject different liquids. Needless to say, the arrangement of the manifolds is not limited thereto.

In this embodiment, each of the manifolds corresponding to the respective nozzle rows is divided into two portions, in the Xa direction. Accordingly, in total, four manifolds 95 are provided such that liquids of four kinds can be ejected, as described below. However, manifolds may be provided corresponding to nozzle rows a and b. Alternatively, one common manifold may be provided with respect to the two rows which are the nozzle row a and the nozzle row b.

The compliance substrate 45 is provided in a surface of the communication plate 15, in which both the first manifold 17 and the second manifold 18 are open. The openings of both the first manifold 17 and the second manifold 18 are sealed with the compliance substrate 45.

In this embodiment, such a compliance substrate 45 includes a sealing film 46 and a fixing substrate 47. The sealing film 46 is constituted of a flexible thin film (which is formed of, for example, polyphenylene sulfide (PPS) or stainless steel (SUS)). The fixing substrate 47 is constituted of a hard material, for example, metal, such as stainless metal (SUS). A part of the fixing substrate 47, which is the portion facing the manifold 95, is completely removed in a thickness direction and forms an opening portion 48. Thus, one surface of the manifold 95 forms a compliance portion 49 which is a flexible portion sealed with only the sealing film 46 having flexibility.

The fixing plate 130 adheres to a surface of the compliance substrate 45, which is the surface on a side opposite to the communication plate 15. In other words, the opening area of the exposure opening portion 133 of the base portion 131 of the fixing plate 130 is a greater than the area of the nozzle plate 20. The liquid ejection surface 20*a* of the nozzle plate 20 is exposed through the exposure opening portion 133. Needless to say, the configuration is not limited thereto. The opening area of the exposure opening portion 133 of the fixing plate 130 may be smaller than that of the nozzle plate 20 and the fixing plate 130 may abut or adhere to the liquid ejection surface 20*a* of the nozzle plate 20. Alternatively, even when the opening area of the exposure opening portion 133 of the fixing plate 130 is smaller than that of the nozzle plate 20, the fixing plate 130 may be provided in a state where the fixing plate 130 is not in contact with the liquid ejection surface 20*a*. In other words, the meaning of "the fixing plate 130 is provided on the liquid ejection surface 20*a* side" includes both a state where the fixing plate 130 is not in contact with the liquid ejection surface 20*a* and a state where the fixing plate 130 is in contact with the liquid ejection surface 20*a*.

An introduction path 44 is provided in the case 40. The introduction path 44 communicates with the manifold 95 and allows ink to be supplied to the manifold 95. In addition, a connection port 43 is provided in the case 40. The connection port 43 communicates with the through-hole 32 of the protection substrate 30 and the COF substrate 98 is inserted therethrough.

In the head main body 110 configured as described above, when ink is ejected, ink is fed from a storage unit through the introduction path 44 and the flow path from the manifold 95 to the nozzle openings 21 is filled with the ink. Then, voltage is applied, in accordance with signals from the driving circuit 97, to each piezoelectric actuator 300 corresponding to the pressure generation chamber 12, in such a manner that the diaphragm, along with the piezoelectric actuator 300, is flexibly deformed. As a result, the pressure in the pressure generation chamber 12 increases, and thus ink droplets are ejected from predetermined nozzle openings 21.

Figure 9:
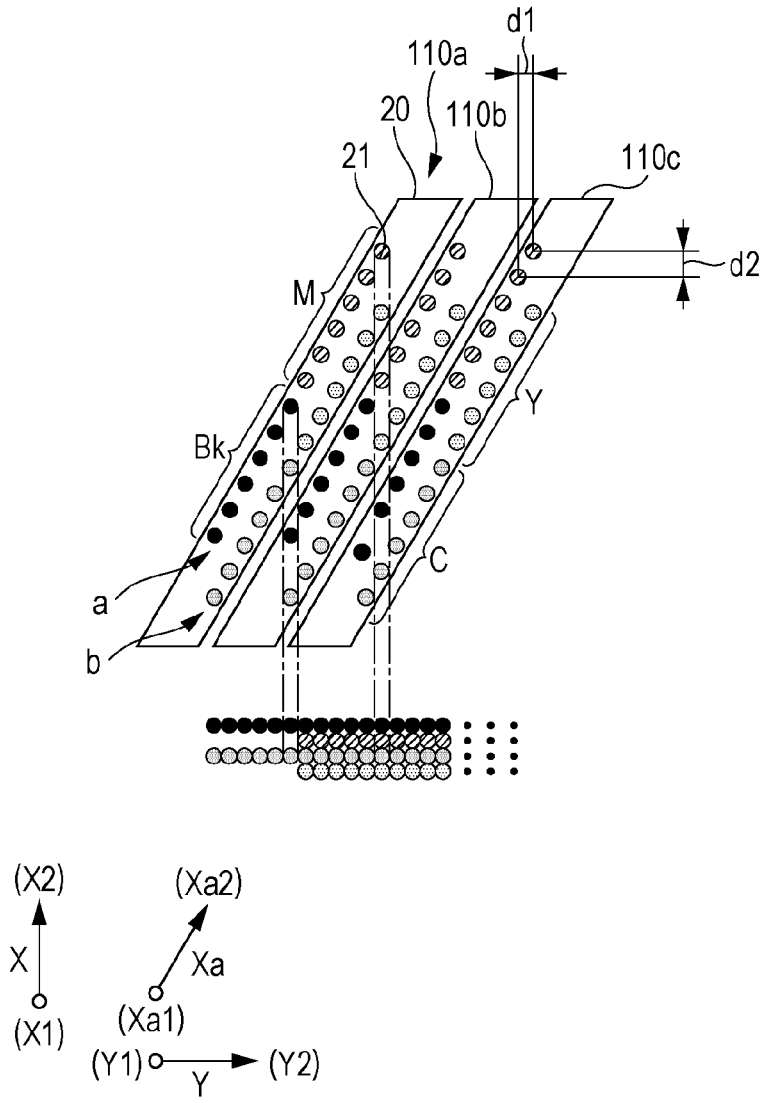
FIG. 9 is a schematic view illustrating the arrangement of nozzle openings of Embodiment 1 of the invention.

Here, details of the configuration in which the alignment direction of the nozzle openings 21 constituting the nozzle row of the head main body 110 is inclined with respect to the X direction as the transporting direction of the recording sheet S will be described with reference to FIGS. 5 and 9. FIG. 9 is a schematic view explaining the arrangement of the nozzle openings of the head main body according to this embodiment.

The plurality of the head main bodies 110 are fixed in a state where, in the in-plane direction of the liquid ejection surface 20*a*, the nozzle rows a and b are inclined with respect to the X direction as the transporting direction of the recording sheet S. The nozzle row referred to in this case is a row of a plurality of nozzle openings 21 aligned in a predetermined direction. In this embodiment, two rows which are the nozzle rows a and b, each of which is constituted of a plurality of nozzle openings 21 aligned in the Xa direction as the predetermined direction, are provided in the liquid ejection surface 20*a*. The Xa direction intersects the X direction at an angle greater than 0° and less than 90°. In this case, it is preferable that the Xa direction intersects the X direction at an angle greater than 0° and less than 45°. In this case, upon comparison with in the case where the Xa direction intersects the X direction at an angle greater than 45° and less than 90°, a gap d1 between adjacent nozzle openings 21 in the Y direction can be further reduced. As a result, the recording head 100 can have high definition in the Y direction. Needless to say, the Xa direction may intersect the X direction at an angle greater than 45° and less than 90°.

The meaning of "the Xa direction intersects the X direction at the angle greater than 0° and less than 45°" implies that, in the plane of the liquid ejection surface 20*a*, the nozzle row is inclined closer to the X direction than a straight line intersecting the X direction at 45°. The gap d1 referred to in this case is a gap between the nozzle openings 21 of the nozzle rows a and b, in a state where the nozzle openings 21 are projected in the X direction, with respect to an imaginary line in the Y direction. Furthermore, a gap between the nozzle openings 21 of the nozzle rows a and b which are projected in the Y direction, with respect to an imaginary line in the X direction, is set to a gap D2.

In this embodiment, liquids of two kinds can be ejected from one nozzle row and liquids of four kinds can be ejected from two nozzle rows, as illustrated in FIG. 9. In other words, when it is assumed that inks of four colors are used, a black ink Bk and a magenta ink M are can be ejected from the nozzle row a and a cyan ink C and a yellow ink Y can be ejected from the nozzle row b. Furthermore, the nozzle row a and the nozzle row b have the same number of nozzle openings 21. The Y-direction positions of the nozzle openings 21 of the nozzle row a and the Y-direction positions of the nozzle openings 21 of the nozzle row b overlap in the X direction.

Head main bodies 110*a* to 110*c* have the nozzle rows a and b. The head main bodies 110*a* to 110*b* are arranged close to each other in the Y direction, and thus the nozzle openings 21 of adjacent head main bodies 110 in the Y direction are aligned in a state where the nozzle openings 21 overlap in the X direction. Accordingly, a part of the nozzle row a of the head main body 110*a*, which is a portion ejecting the magenta ink M, and a part of the nozzle row b of the head main body 110*a*, which is a portion ejecting the yellow ink Y, overlap, in the X direction, with a part of the nozzle row a of the head main body 110*b*, which is a portion ejecting the black ink Bk, and a part of the nozzle row b of the head main body 110*b*, which is a portion ejecting the cyan ink C. Therefore, lines of four colors are aligned in one row in the X direction, and thus a color image can be printed. Similarly, in the case of adjacent head main bodies 110*b* and 110*c* in the Y direction, the nozzle openings 21 are aligned in a state where the nozzle openings 21 overlap in the X direction.

At least some of nozzle openings 21 of nozzle rows of adjacent head main bodies 110, which are the nozzle rows ejecting ink of the same color, overlap in the X direction. As a result, the image quality in a joining portion between the head main bodies 110 can be improved. In other words, one nozzle opening 21 of the nozzle row a of the head main body 110*a*, which is the nozzle row ejecting the magenta ink M, and one nozzle opening 21 of the nozzle row a of the head main body 110*b*, which is the nozzle row ejecting the magenta ink M, overlap in the X direction. Ejection operations through the two overlapping nozzle openings 21 are controlled, in such a manner that image quality deterioration, such as banding and streaks, can be prevented from occurring in the joining portion between the adjacent head main bodies 110. In an example illustrated in FIG. 9, only one nozzle opening 21 of one head main body 110 and one nozzle openings 21 of the other head main body 110 overlap in the X direction. However, two or more nozzle openings 21 of one head main body 110 and two or more nozzle openings 21 of the other head main body 110 may overlap in the X direction.

Needless to say, the arrangement relating to colors may not be limited thereto. Although not particularly illustrated, the black ink Bk, the magenta ink M, the cyan ink C, and the yellow ink Y can be ejected from, for example, one nozzle row.

As described above, the head unit 101 is constituted by fixing four recording heads 100 to the head fixing substrate 102, in which each recording head 100 has a plurality of head main bodies 110. Parts of nozzle rows of adjacent recording heads 100 overlap in the X direction, as illustrated by a straight line L in FIG. 5. In other words, similarly to the relationship between adjacent head main bodies 110 in one recording head 100, adjacent head main bodies 110 of adjacent recording heads 100 in the Y direction are arranged close to each other in the Y direction, and thus a color image can be printed in a portion between the adjacent recording heads 100 and, further, the image quality in the joining portion between the adjacent recording heads 100 can be improved. Needless to say, the number of overlapping nozzle openings 21 between adjacent recording heads 100, which overlap in the X direction, is not necessarily the same as the number of overlapping nozzle openings 21 between adjacent head main bodies 110 in one recording head 100, which overlap in the X direction.

As described above, the nozzle rows between adjacent head main bodies 110 the nozzle rows between adjacent recording heads 100 partially overlap in the X direction, and thus the image quality in the joining portion can be improved.

It is preferable that, in a portion between nozzle openings 21 of nozzle rows, which are adjacent in the Xa direction, a pitch between adjacent nozzles and the an angle between the X direction and the Xa direction are set to satisfy a condition in which the relationship between the gap d1 in the X direction and the gap d2 in the Y direction satisfies an integer ratio. In this case, when an image is printed in accordance with image data which is constituted of pixels having a matrix shape in which the pixels are arranged in both the X direction and the Y direction, it is easy to pair each nozzle with each pixel. Needless to say, the relationship is not limited to the relationship of an integer ratio.

In a plan view seen from the liquid ejection surface 20*a* side, the recording head 100 of this embodiment has a substantially parallelogram shape, as illustrated in FIG. 5. The reason for this is as follows. The Xa direction as the alignment direction of the nozzle openings 21 which constitute the nozzle rows a and b of each head main body 110 is inclined with respect to the X direction as the transporting direction of the recording sheet S. Furthermore, the recording head 100 is formed in a shape parallel to the Xa direction as an inclined direction of the nozzle row b. In other words, the fixing plate 130 has a substantially parallelogram shape. Needless to say, in a plan view seen from the liquid ejection surface 20*a* side, the shape of the recording head 100 is not limited to a substantially parallelogram. The recording head 100 may have a trapezoidal-rectangular shape, a polygonal shape, or the like.

An example in which two nozzle rows are provided in one head main body is described in the embodiment described above. However, needless to say, even when three or more nozzle rows are provided, the same effects described above may be obtained. Furthermore, when two nozzle rows are provided in one head main body 110, as in the case of this embodiment, nozzle openings 21 of the two nozzle rows can be arranged in a portion between two manifolds 95 respectively corresponding to the two nozzle rows, as illustrated in FIG. 7. Thus, a gap between the two nozzle rows in the Ya direction can be reduced, compared to in the case where nozzle openings 21 of a plurality of nozzle rows are arranged on the same side with respect to manifolds respectively corresponding to the plurality of nozzle rows. As a result, in the nozzle plate 20, the area required for providing two nozzle rows can be reduced. In addition, it is easy to connect the respective piezoelectric actuators 300 corresponding to two nozzle rows and the respective COF substrates 98.

In this embodiment, the nozzle row a and the nozzle row b have the same number of nozzle openings 21. Accordingly, in the nozzle rows, the same number of nozzle openings 21 can overlap in the X direction, and thus it is possible to effectively eject liquid. However, nozzle rows do not have necessarily the same number of nozzle openings. Furthermore, the nozzle rows a and b may eject liquids of the same kind. In other words, the nozzle rows a and b may eject, for example, ink of the same color.

In this embodiment, it is preferable that the head main body 110 has s nozzle plate 20 having two nozzle rows. In this case, nozzle rows can be arranged with higher precision. Needless to say, one nozzle row may be provided in each nozzle plate 20. The nozzle plate 20 is constituted of a stainless-steel (SUS) plate, a silicon substrate, or the like.

Figure 10:
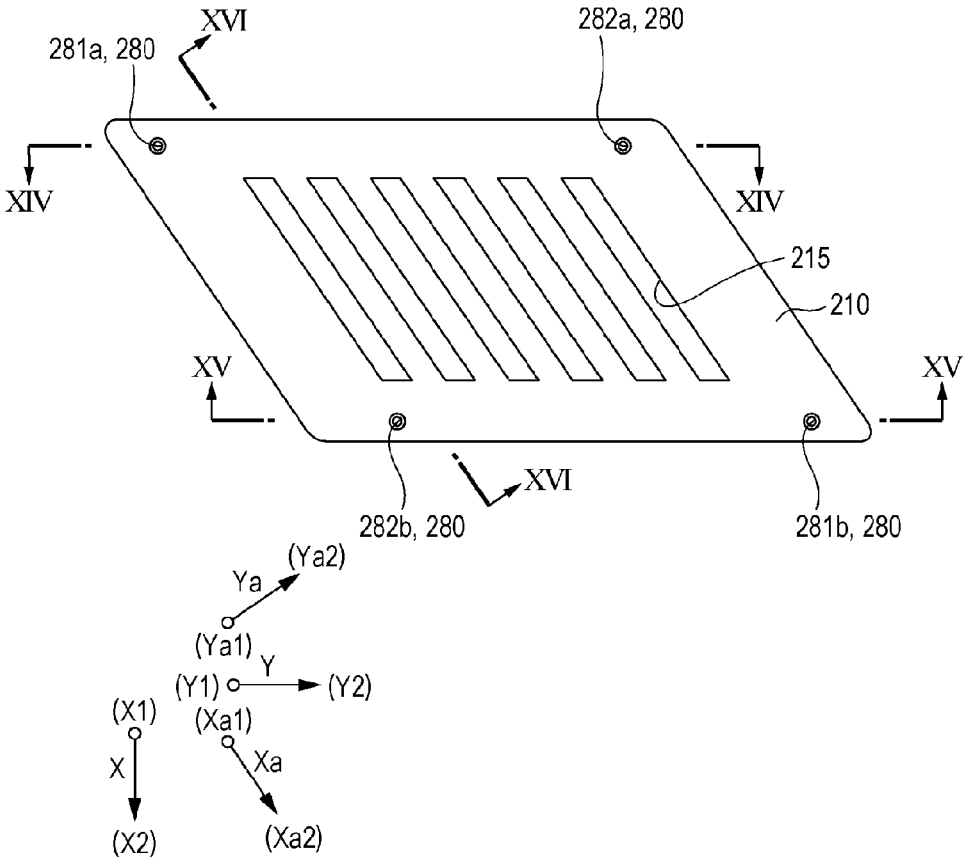
FIG. 10 is a plan view of a flow-path member (which is a first flow-path member) according to Embodiment 1 of the invention.
Figure 11:
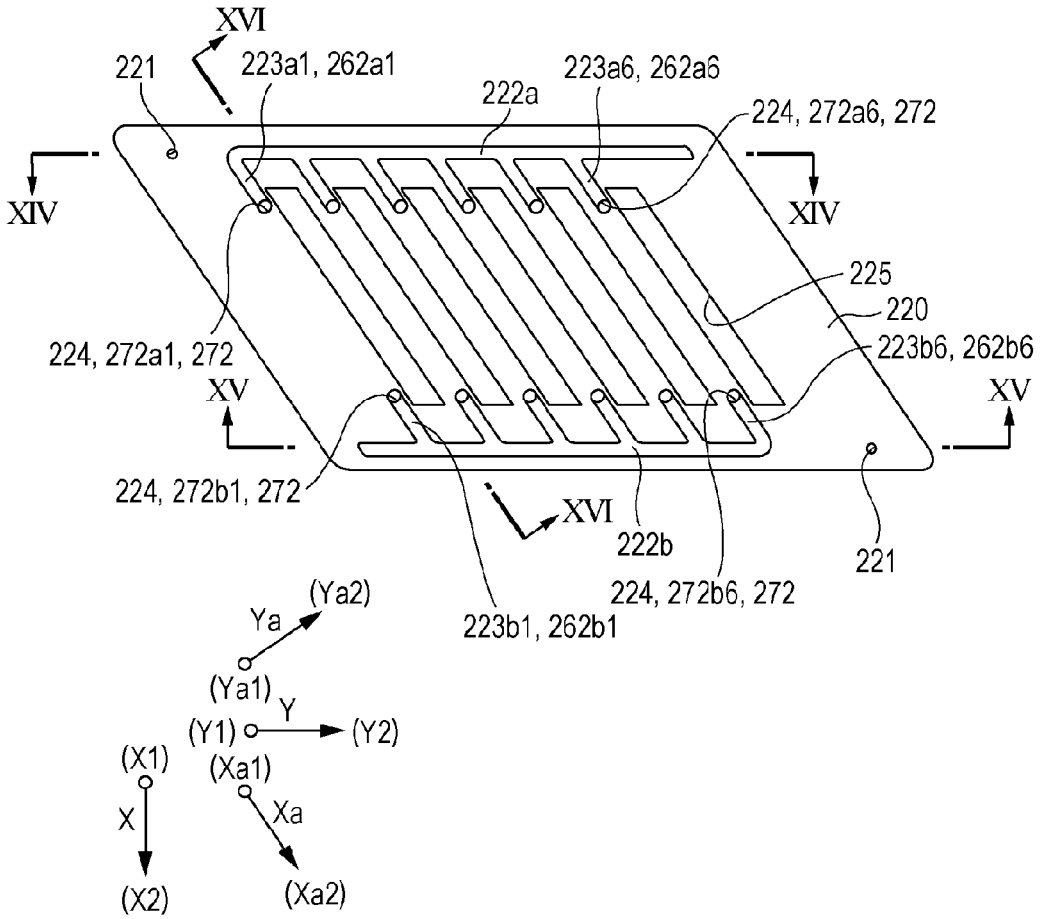
FIG. 11 is a plan view of a second flow-path member according to Embodiment 1 of the invention.
Figure 12:
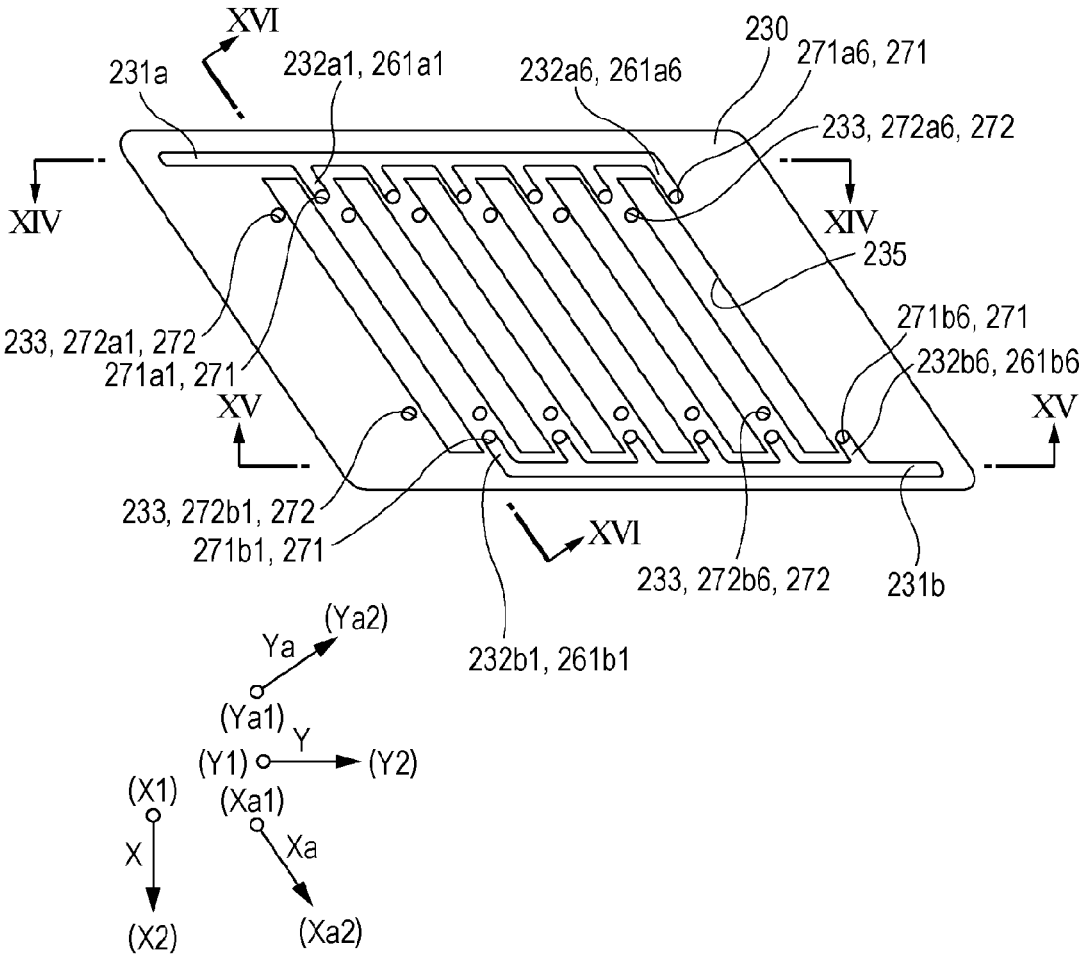
FIG. 12 is a plan view of a third flow-path member according to Embodiment 1 of the invention.
Figure 13:
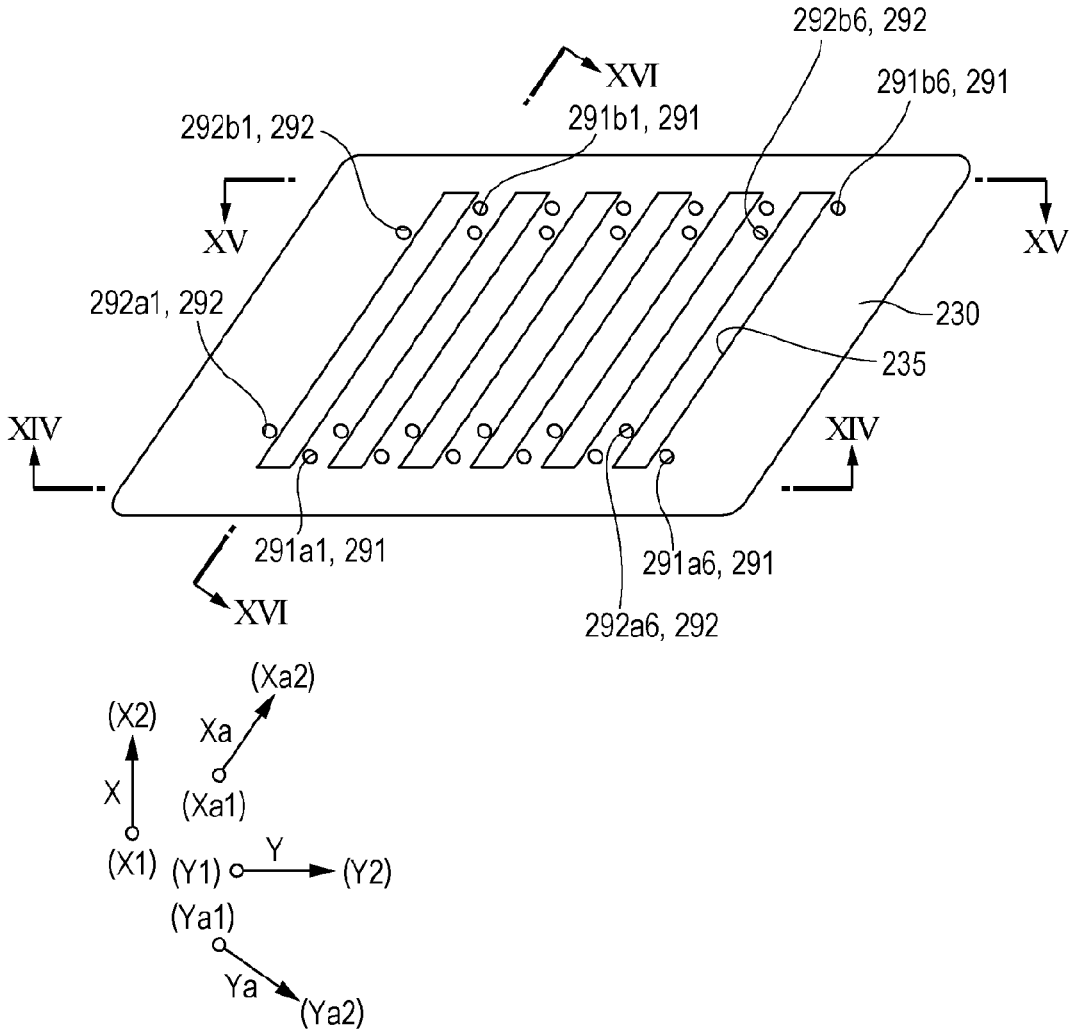
FIG. 13 is a bottom view of the third flow-path member according to Embodiment 1 of the invention.
Figure 14:
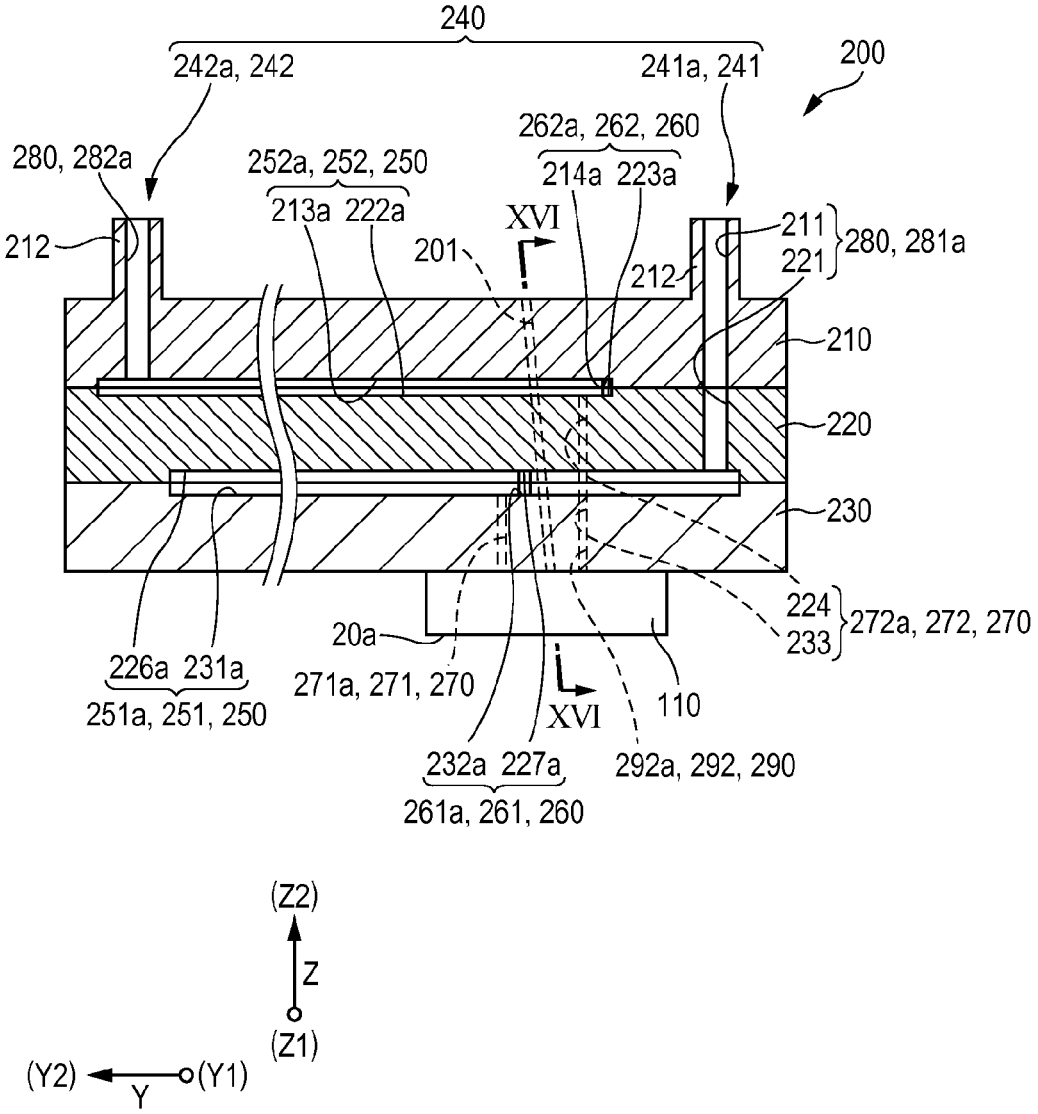
FIG. 14 is a cross-sectional view of FIGS. 10 to 13, taken along a line XIV-XIV.
Figure 15:
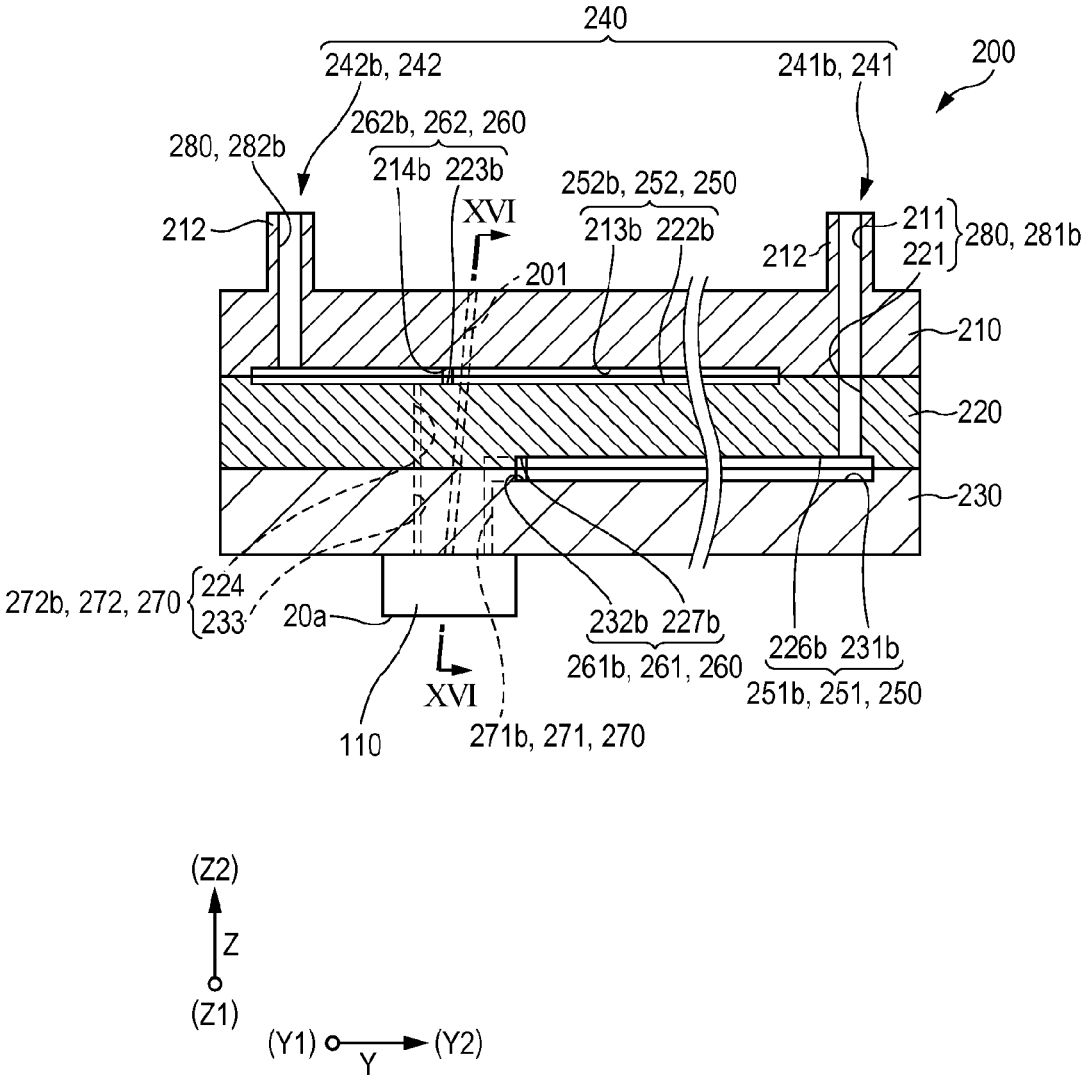
FIG. 15 is a cross-sectional view of FIGS. 10 to 13, taken along a line XV-XV.
Figure 16:
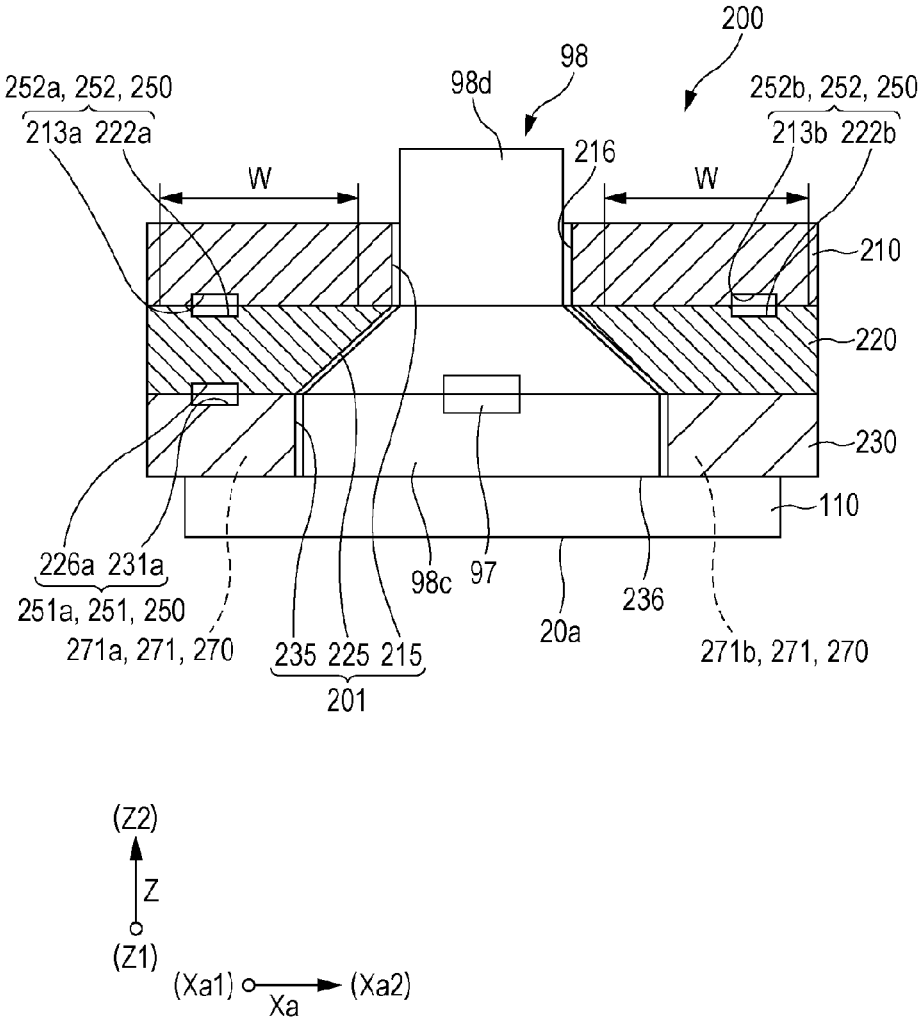
FIG. 16 is a cross-sectional view of FIGS. 10 to 13, taken along a line XVI-XVI.

Details of the flow-path member 200 according to this embodiment will be described with reference to FIGS. 10 to 16. FIG. 10 is a plan view of a first flow-path member 210 as the flow-path member 200, FIG. 11 is a plan view of a second flow-path member 220 as the flow-path member 200, and FIG. 12 is a plan view of a third flow-path member 230 as the flow-path member 200. FIG. 13 is a bottom view of the third flow-path member 120. FIG. 14 is a cross-sectional view of FIGS. 10 to 13, taken along a line XIV-XIV, and FIG. 15 is a cross-sectional view of FIGS. 10 to 13, taken along a line XV-XV. FIG. 16 is a cross-sectional view of FIGS. 10 to 15, taken along a line XVI-XVI. FIGS. 10 to 12 are plan views seen from the Z2 side and FIG. 13 is a bottom view seen from the Z1 side.

A flow path 240 through which ink flows is provided in the flow-path member 200. In this embodiment, the flow-path member 200 includes three flow-path members stacked in the Z direction and a plurality of flow paths 240. The three flow-path members are a first flow-path member 210, a second flow-path member 220, and a third flow-path member 230. In the Z direction, the first flow-path member 210, the second flow-path member 220, and the third flow-path member 230 are stacked in order from the holding member 120 side (see FIG. 2) to the head main body 110 side. Although not particularly illustrated, the first flow-path member 210, the second flow-path member 220, and the third flow-path member 230 are fixed in an adhesive manner, using an adhesive. However, the configuration is not limited thereto. The first flow-path member 210, the second flow-path member 220, and the third flow-path member 230 may be fixed to each other, using a fixing unit, such as a screw. Furthermore, although the material forming the flow-path member is not particularly limited, the flow-path member can be constituted of, for example, metal, such as SUS, or resin.

In the flow path 240, one end is an introduction flow path 280 and the other end is a connection portion 290. Ink supplied from a member (which is the holding member 120, in this embodiment) upstream from the flow path 240 is introduced through the introduction flow path 280. The connection portion 290 functions as an output port through which the ink is supplied to the head. In this embodiment, four flow paths 240 are provided. In each flow path 240, ink is supplied to one introduction flow path 280. In the middle of each flow path 240, the flow path 240 branches into a plurality of flow paths. Therefore, in each flow path 240, the ink is supplied to the head main body 110 through a plurality of connection portions 290.

Some of the four flow paths 240 are first flow paths 241 and the others are second flow paths 242. In this embodiment, two first flow paths 241 and two second flow paths 242 are provided. One of the two first flow paths 241 is referred to as a first flow path 241*a* and the other is referred to as a first flow path 241*b*. Hereinafter, the first flow path 241 indicates both the first flow path 241*a* and the first flow path 241*b*. The second flow path 242 has a similar configuration to that described above.

The first flow path 241 includes a first introduction flow path 281. The first introduction flow path 281 connects a first distribution flow path 251 of the first flow path 241 and a flow path (which is the flow path of the holding member 120, in this embodiment) upstream from the flow-path member 200. The first distribution flow path 251 will be described below. In this embodiment, each of two first flow paths 241*a* and 241*b* has a first introduction flow path 281*a* and a first introduction flow path 281*b*.

Specifically, the first introduction flow path 281*a* is constituted of a through-hole 211 and a through-hole 221 which communicate with each other. The through-hole 211 is open to the top surface of a protrusion portion 212 which is provided on the Z2-side surface of the first flow-path member 210 and the through-hole 211 passes through, in the Z direction, both the first flow-path member 210 and the protrusion portion 212. The through-hole 221 passes through the second flow-path member 220 in the Z direction. The first introduction flow path 281*b* has a similar configuration to that described above. Hereinafter, the first introduction flow path 281 indicates both the first introduction flow path 281*a* and the first introduction flow path 281*b*.

The second flow path 242 includes a second introduction flow path 282. The second introduction flow path 282 connects a second distribution flow path 252 of the second flow path 242 and a flow path (which is the flow path of the holding member 120, in this embodiment) upstream from the flow-path member 200. The second distribution flow path 252 will be described below. In this embodiment, each of two first flow paths 242*a* and 242*b* has a second introduction flow path 282*a* and a second introduction flow path 282*b*.

Specifically, the second introduction flow path 282*a* is a through-hole open on the top surface of a protrusion portion 212 which is provided on the Z2-side surface of the first flow-path member 210. The second introduction flow path 282*a* passes through, in the Z direction, both the first flow-path member 210 and the protrusion portion 213. The second introduction flow path 282*b* has a similar configuration to that described above. Hereinafter, the second introduction flow path 282 indicates both the second introduction flow path 282*a* and the second introduction flow path 282*b*.

The introduction flow path 280 indicates all of the four introduction flow paths described above. The introduction flow path 280 corresponds to an inlet port of the invention.

In this embodiment, in a plan view illustrated in FIG. 10, the first introduction flow path 281*a* is disposed in the vicinity of an upper left corner of the first flow-path member 210 and the first introduction flow path 281*b* is disposed in the vicinity of a lower right corner of the first flow-path member 210. In the plan view illustrated in FIG. 10, the second introduction flow path 282*a* is disposed in the vicinity of a upper right corner of the first flow-path member 210 and the second introduction flow path 282*b* is disposed in the vicinity of a lower left corner of the first flow-path member 210.

The first flow path 241 includes the first distribution flow path 251 which is formed by both the second flow-path member 220 and the third flow-path member 230. The first distribution flow path 251 is a part of the first flow path 241, through which ink flows in a direction parallel to the liquid ejection surface 20*a*. In this embodiment, two first flow paths 241 are formed, and thus two first distribution flow paths 251 are formed. One of the two first distribution flow paths 251 is referred to as a first distribution flow path 251*a* and the other is referred to as a first distribution flow path 251*b*.

An distribution groove portion 226*a* and an distribution groove portion 231*a* are matched and sealed, in such a manner that the first distribution flow path 251*a* is formed. The distribution groove portion 226*a* is formed on the Z1-side surface of the second flow-path member 220 and extends in the Y direction. The distribution groove portion 231*a* is formed on the Z2-side surface of the third flow-path member 230 and extends in the Y direction. An distribution groove portion 226*b* and an distribution groove portion 231*b* are matched and sealed, in such a manner that the first distribution flow path 251*b* is formed. The distribution groove portion 226*b* is formed on the Z1-side surface of the second flow-path member 220 and extends in the Y direction. The distribution groove portion 231*b* is formed on the Z2-side surface of the third flow-path member 230 and extends in the Y direction.

The first distribution flow path 251*a* is constituted of both the distribution groove portions 226*a* in the second flow-path member 220 and the distribution groove portion 231*a* in the third flow-path member 230 and the first distribution flow path 251*b* is constituted of both the distribution groove portion 226*b* in the second flow-path member 220 and the distribution groove portion 231*b* in the third flow-path member 230. As a result, the cross-sectional areas of the first distribution flow paths 251*a* and 251*b* are widened, and thus pressure losses in the first distribution flow paths 251*a* and 251*b* are reduced. The first distribution flow path 251*a* may be constituted of only the distribution groove portion 226*a* in the second flow-path member 220 and the first distribution flow path 251*b* may be constituted of only the distribution groove portion 226*b* in the second flow-path member 220. Alternatively, the first distribution flow path 251*a* may be constituted of only the distribution groove portion 231*a* in the third flow-path member 230 and the first distribution flow path 251*b* may be constituted of only the distribution groove portion 231*b* in the third flow-path member 230. The distribution groove portions 226*a* and 226*b* are formed in only the second flow-path member 220 on the Z2 side, in such a manner that the degree of freedom in the arrangement of the first flow path 241 can be improved while preventing the first distribution flow paths 251*a* and 251*b* from interfering with the COF substrate 98 of which the Xa-direction width is reduced as the COF substrate 98 extends from the Z1 side to the Z2 side, as described below.

The first distribution flow path 251*a* and the first distribution flow path 251*b* are disposed in both areas located X-directionally outside the opening portion 201 (in other words, a third opening portion 235) through which the COF substrate 98 is inserted.

The second flow path 242 includes the second distribution flow path 252 which is formed by both the first flow-path member 210 and the second flow-path member 220. The second distribution flow path 252 is a part of the second flow path 242, through which ink flows in a direction parallel to the liquid ejection surface 20*a*. In this embodiment, two second flow paths 242 are formed, and thus two second distribution flow paths 252 are formed. One of the two second distribution flow paths 252 is referred to as a second distribution flow path 252*a* and the other is referred to as a second distribution flow path 252*b*.

An distribution groove portion 213*a* and an distribution groove portion 222*a* are matched and sealed, in such a manner that the second distribution flow path 252*a* is formed. The distribution groove portion 213*a* is formed on the Z1-side surface of the first flow-path member 210 and extends in the Y direction. The distribution groove portion 222*a* is formed on the Z2-side surface of the second flow-path member 220 and extends in the Y direction. An distribution groove portion 213*b* and an distribution groove portion 222*b* are matched and sealed, in such a manner that the second distribution flow path 252*b* is formed. The distribution groove portion 213*b* is formed on the Z1-side surface of the first flow-path member 210 and extends in the Y direction. The distribution groove portion 222*b* is formed on the Z2-side surface of the second flow-path member 220 and extends in the Y direction.

The second distribution flow path 252*a* is constituted of both the distribution groove portions 213*a* in the first flow-path member 210 and the distribution groove portion 222*a* in the second flow-path member 220 and the second distribution flow path 252*b* is constituted of both the distribution groove portion 213*b* in the first flow-path member 210 and the distribution groove portion 222*b* in the second flow-path member 220. As a result, the cross-sectional areas of the second distribution flow paths 252*a* and 221*b* are widened, and thus pressure losses in the second distribution flow paths 252*a* and 252*b* are reduced. The second distribution flow path 252*a* may be constituted of only the distribution groove portion 2136*a* in the first flow-path member 210 and the second distribution flow path 252*b* may be constituted of only the distribution groove portion 213*b* in the first flow-path member 210. Alternatively, the second distribution flow path 252*a* may be constituted of only the distribution groove portion 222*a* in the second flow-path member 220 and the second distribution flow path 252*b* may be constituted of only the distribution groove portion 222*b* in the second flow-path member 220. The distribution groove portions 222*a* and 222*b* are formed in only the first flow-path member 210 on the Z2 side, in such a manner that, similarly to in the case of the first distribution flow paths 251*a* and 251*b* described above, the degree of freedom in the arrangement of the second flow path 242 can be improved while preventing the second distribution flow paths 252*a* and 252*b* from interfering with the COF substrate 98.

The second distribution flow path 252*a* and the second distribution flow path 252*b* are disposed in both areas located X-directionally outside the opening portion 201 (in other words, a second opening portion 225) through which the COF substrate 98 is inserted.

Hereinafter, the first distribution flow path 251 indicates both the first distribution flow path 251*a* and the first distribution flow path 251*b*. Furthermore, the second distribution flow path 252 indicates both the second distribution flow path 252*a* and the second distribution flow path 252*b*. In addition, the distribution flow path 250 indicates all of the four distribution flow paths described above. The distribution flow path 250 corresponds to a mainstream flow path. In some cases, the mainstream flow path will be referred to simply as a mainstream portion, instead of the mainstream flow path.

In the first flow path 241 of this embodiment, one introduction flow path 280 branches into a plurality of connection portions 290. In other words, the first distribution flow path 251 branches into a plurality of first bifurcation flow paths 261, in the same surface (which is a boundary surface in which the second flow-path member 220 and the third flow-path member 230 are bonded to each other) with the first distribution flow path 251.

In this embodiment, the first distribution flow path 251 branches into six first bifurcation flow paths 261, in the surface (which is a boundary surface between the second flow-path member 220 and the third flow-path member 230) parallel to the liquid ejection surface 20*a*. The six first bifurcation flow paths 261 branching off from the first distribution flow path 251*a* are referred to as first bifurcation flow paths 261*a*1 to 261*a*6. Hereinafter, the first bifurcation flow path 261*a* indicates all of the six bifurcation flow paths connected to the first bifurcation flow path 261*a*.

Similarly, six first bifurcation flow paths 261 branching off from the first distribution flow path 251*b* are referred to as first bifurcation flow paths 261*b*1 to 261*b*6. Hereinafter, the first bifurcation flow path 261*b* indicates all of the six bifurcation flow paths connected to the first bifurcation flow path 261*b*. In addition, the first bifurcation flow path 261 indicates all of the twelve bifurcation flow paths connected to the first bifurcation flow paths 261*a* and 261*b*.

Reference letters and numerals corresponding to the first bifurcation flow paths 261*a*2 to 261*a*5 of the six first bifurcation flow paths 261*a*1 to 261*a*6 aligned in the Y direction are omitted in the accompanying drawings. However, it is assumed that the first bifurcation flow paths 261*a*2 to 261*a*5 are aligned in order from the Y1 side to the Y2 side. The first bifurcation flow paths 261*b*1 to 261*b*6 have a similar configuration to that described above.

Specifically, a plurality of branch groove portions 232*a* which communicate with the distribution groove portion 231*a* and extend to the opening portion 201 side are provided in the Z2-side surface of the third flow-path member 230. A plurality of branch groove portions 227*a* which communicate with the distribution groove portion 226*a* and extend to the opening portion 201 side are provided in the Z1-side surface of the second flow-path member 220. The branch groove portion 227*a* and the branch groove portion 232*a* are sealed in a state where the branch groove portion 227*a* and the branch groove portion 232*a* face each other, in such a manner that the first bifurcation flow path 261*a* is formed.

A plurality of branch groove portions 232*b* which communicate with the distribution groove portion 231*b* and extend to the opening portion 201 side are provided in the Z2-side surface of the third flow-path member 230. A plurality of branch groove portions 227*b* which communicate with the distribution groove portion 226*b* and extend to the opening portion 201 side are provided in the Z1-side surface of the second flow-path member 220. The branch groove portion 227*b* and the branch groove portion 232*b* are sealed in a state where the branch groove portion 227*b* and the branch groove portion 232*b* face each other, in such a manner that the first bifurcation flow path 261*b* is formed.

The first bifurcation flow path 261*a* is constituted of both the branch groove portions 227*a* in the second flow-path member 220 and the branch groove portion 232*a* in the third flow-path member 230 and the first bifurcation flow path

261*b* is constituted of both the branch groove portion 227*b* in the second flow-path member 220 and the branch groove portion 232*b* in the third flow-path member 230. As a result, the cross-sectional areas of the first bifurcation flow paths 261*a* and 261*b* are widened, and thus pressure losses in the first bifurcation flow paths 261*a* and 261*b* are reduced. The first bifurcation flow path 261*a* may be constituted of only the branch groove portion 227*a* in the second flow-path member 220 and the first bifurcation flow path 261*b* may be constituted of only the branch groove portion 227*b* in the second flow-path member 220. Alternatively, the first bifurcation flow path 261*a* may be constituted of only the branch groove portion 232*a* in the third flow-path member 230 and the first bifurcation flow path 261*b* may be constituted of only the branch groove portion 232*b* in the third flow-path member 230. For example, the branch groove portions 227*a* and 227*b* are formed in only the second flow-path member 220 on the Z2 side. As a result, in an area Q which is inclined in the Ya direction, and thus the Ya-direction width increases as the area Q extends from the Z1 side to the Z2 side, as described below, the degree of freedom in the arrangement of the first flow path 241 can be improved while preventing interference with the COF substrate 98. Furthermore, the branch groove portions 232*a* and 232*b* are formed in only the third flow-path member 230 on the Z1 side. As a result, in an area P of which the width in the Ya direction increases as the area P extends from the Z2 side to the Z1 side, the degree of freedom in the arrangement of the first flow path 241 can be improved while preventing interference with the COF substrate 98.

In the second flow path 242, one introduction flow path 280 branches into a plurality of connection portions 290. The second distribution flow path 252 branches into a plurality of second bifurcation flow paths 262, in the same surface (which is a boundary surface in which the first flow-path member 210 and the second flow-path member 220 are bonded to each other) with the second distribution flow path 252. Details of this will be described below.

In this embodiment, the second distribution flow path 252 branches into six second bifurcation flow paths 262, in the surface (which is a boundary surface between the first flow-path member 210 and the second flow-path member 220) parallel to the liquid ejection surface 20*a*. The six second bifurcation flow paths 262 branching off from the second distribution flow path 252*a* are referred to as second bifurcation flow paths 262*a*1 to 262*a*6.

Similarly, six second bifurcation flow paths 262 branching off from the second distribution flow path 252*b* are referred to as second bifurcation flow paths 262*b*1 to 262*b*6.

Hereinafter, the second bifurcation flow path 262*a* indicates all of the six bifurcation flow paths connected to the second bifurcation flow path 262*a*. The second bifurcation flow path 262*b* indicates all of the six bifurcation flow paths connected to the second bifurcation flow path 262*b*. The second bifurcation flow path 262 indicates all of the twelve bifurcation flow path connected to the second bifurcation flow paths 262*a* and 262*b*. Furthermore, the bifurcation flow path 260 indicates all of the twenty-four bifurcation flow paths described above.

Reference letters and numerals corresponding to second bifurcation flow paths 262*a*2 to 262*a*5 of the six second bifurcation flow paths 262*a*1 to 262*a*6 aligned in the Y direction are omitted in the accompanying drawings. However, it is assumed that the second bifurcation flow paths 262*a*2 to 262*a*5 are aligned in order from the Y1 side to the Y2 side. The second bifurcation flow paths 262*b*1 to 262*b*6 have a similar configuration to that described above.

Specifically, a plurality of branch groove portions 223*a* which communicate with the distribution groove portions 222*a* and extend to the opening portion 201 side are provided in the Z2-side surface of the second flow-path member 220. In addition, a plurality of branch groove portions 214*a* which communicate with the distribution groove portions 213*a* and extend to a side opposite to the opening portion 201 side are provided in the Z1-side surface of the first flow-path member 210. The branch groove portion 223*a* and the branch groove portion 214*a* are sealed in a state where the branch groove portion 223*a* and the branch groove portion 214*a* face each other, in such a manner that the second bifurcation flow path 262*a* is formed.

A plurality of branch groove portions 223*b* which communicate with the distribution groove portions 222*b* and extend to the opening portion 201 side are provided in the Z2-side surface of the second flow-path member 220. In addition, a plurality of branch groove portions 214*b* which communicate with the distribution groove portions 213*b* and extend to the opening portion 201 side are provided in the Z1-side surface of the first flow-path member 210. The branch groove portion 223*b* and the branch groove portion 214*b* are sealed in a state where the branch groove portion 223*b* and the branch groove portion 214*b* face to each other, in such a manner that the second bifurcation flow path 262*b* is formed.

The second bifurcation flow path 262*a* is constituted of both the branch groove portions 214*a* in the first flow-path member 210 and the branch groove portion 223*a* in the second flow-path member 220 and the second bifurcation flow path 262*b* is constituted of both the branch groove portion 214*b* in the first flow-path member 210 and the branch groove portion 223*b* in the second flow-path member 220. As a result, the cross-sectional areas of the second bifurcation flow paths 262*a* and 262*b* are widened, and thus pressure losses in the second bifurcation flow paths 262*a* and 262*b* are reduced. The second bifurcation flow path 262*a* may be constituted of only the branch groove portion 214*a* in the first flow-path member 210 and the second bifurcation flow path 262*b* may be constituted of only the branch groove portion 214*b* in the first flow-path member 210. Alternatively, the second bifurcation flow path 262*a* may be constituted of only the branch groove portion 223*a* in the second flow-path member 220 and the second bifurcation flow path 262*b* may be constituted of only the branch groove portion 223*b* in the second flow-path member 220. The branch groove portions 214*a* and 214*b* are formed in only the first flow-path member 210 on the Z2 side. Accordingly, in the area Q which is inclined in the Ya direction, and thus the Ya-direction width increases as the area Q extends from the Z1 side to the Z2 side, as described below, the degree of freedom in the arrangement of the second flow path 242 can be improved while preventing interference with the COF substrate 98. Furthermore, the branch groove portions 223*a* and 223*b* are formed in only the second flow-path member 220 on the Z1 side. As a result, in the area P of which the width in the Ya direction increases as the area P extends from the Z2 side to the Z1 side, the degree of freedom in the arrangement of the second flow path 242 can be improved while preventing interference with the COF substrate 98.

An end portion of the first bifurcation flow path 261, which is the end portion on a side opposite to the first distribution flow path 251, is connected to a first vertical flow path 271. Specifically, the first vertical flow path 271 is formed as a through-hole which passes through the third flow-path member 230 in the Z direction.

In this embodiment, vertical flow paths are respectively connected to the first bifurcation flow paths 261*a*1 to 261*a*6 and 261*b*1 to 261*b*6. In other words, in total, twelve first vertical flow paths 271*a*1 to 271*a*6 and 271*b*1 to 271*b*6 are respectively connected to the first bifurcation flow paths.

Similarly, an end portion of the second bifurcation flow path 262, which is the end portion on a side opposite to the second distribution flow path 252, is connected to a second vertical flow path (which is the second flow path of the invention) 272. Specifically, a through-hole 224 is provided in the second flow-path member 220, in a state where the through-hole 224 passes through the second flow-path member 220 in the Z direction. A through-hole 233 is provided in the third flow-path member 230, in a state where the through-hole 233 passes through the third flow-path member 230 in the Z direction. The through-hole 224 and the through-hole 233 communicate with each other, in such a manner that the second vertical flow path 272 is formed.

In this embodiment, in total, twelve second vertical flow paths 272*a*1 to 272*a*6 and 272*b*1 to 272*b*6 are respectively connected to second bifurcation flow paths 262*a*1 to 262*a*6 and 262*b*1 to 262*b*6.

Hereinafter, a first vertical flow path 271*a* indicates the first vertical flow paths 271*a*1 to 271*a*6. A first vertical flow path 271*b* indicates the first vertical flow paths 271*b*1 to 271*b*6. The first vertical flow path 271 indicates all of the first vertical flow paths 271*a* and the first vertical flow paths 271*b*.

Similarly, a second vertical flow path 272*a* indicates the second vertical flow paths 272*a*1 to 272*a*6. A second vertical flow path 272*b* indicates the second vertical flow paths 272*b*1 to 272*b*6. The second vertical flow path 272 indicates all of the second vertical flow paths 272*a* and the second vertical flow paths 272*b*.

Furthermore, a vertical flow path 270 indicates all of the twenty-four vertical flow paths described above.

The bifurcation flow path 260, the vertical flow path 270, and the connection portion 290 correspond to tributary flow paths. In some cases, the tributary flow path will be referred to simply as a tributary portion.

Reference letters and numerals corresponding to the first vertical flow paths 271*a*2 to 271*a*5 of the six first vertical flow paths 271*a*1 to 271*a*6 aligned in the Y direction are omitted in the accompanying drawings. However, it is assumed that the first vertical flow paths 271*a*2 to 271*a*5 are aligned in order from the Y1 side to the Y2 side. The first vertical flow paths 271*b*1 to 271*b*6, the second vertical flow paths 272*a*1 to 272*a*6, and the second vertical flow paths 272*b*1 to 272*b*6 have a similar configuration to that described above.

The vertical flow path 270 described above has the connection portion 290 which is an opening on the Z1 side of the third flow-path member 230. The connection portion 290 communicates with the introduction path 44 provided in the head main body 110. Details of this will be described below.

In this embodiment, the first vertical flow paths 271*a*1 to 271*a*6 respectively have first connection portions 291*a*1 to 291*a*6 which are openings on the Z1 side of the third flow-path member 230. In addition, the first vertical flow paths 271*b*1 to 271*b*6 respectively have first connection portions 291*b*1 to 291*b*6 which are openings on the Z1 side of the third flow-path member 230. Similarly, the second vertical flow paths 272*a*1 to 272*a*6 respectively have second connection portions 292*a*1 to 291*a*6 which are openings on the Z1 side of the third flow-path member 230. In addition, the second vertical flow paths 272*b*1 to 272*b*6 respectively have second connection portions 292*b*1 to 291*b*6 which are openings on the Z1 side of the third flow-path member 230.

The first connection portion 291*a*1, the first connection portion 291*b*1, the second connection portion 292*a*1, and the second connection portion 292*b*1 are connected to one of the six head main bodies 110. The first connection portions 291*a*2 to 291*a*6, the first connection portions 291*b*2 to 291*b*6, the second connection portions 292*a*2 to 292*a*6, and the second connection portions 292*b*2 to 292*b*6 have a similar configuration to that described above. In other words, the first flow path 241*a*, the first flow path 241*b*, the second flow path 242*a*, and the second flow path 242*b* are connected to one head main body 110.

Hereinafter, the first connection portion 291*a* indicates the first connection portions 291*a*1 to 291*a*6. The first connection portion 291*b* indicates the first connection portions 291*b*1 to 291*b*6. A first connection portion 291 indicates all of the first connection portions 291*a* and the first connection portions 291*b*.

Similarly, the second connection portion 292*a* indicates the second connection portions 292*a*1 to 292*a*6. The second connection portion 292*b* indicates the second connection portion 292*b*1 to 292*b*6. A second connection portion 292 indicates all of the second connection portions 292*a* and the second connection portions 292*b*.

Furthermore, a connection portion 290 indicates all of the twenty-four connection portions described above. The connection portion 290 corresponds to an outlet port of the invention.

The flow-path member 200 according to this embodiment includes four flow paths 240, in other words, the first flow path 241*a*, the first flow path 241*b*, a second flow path 242*a*, and a second flow path 242*b*, as described above. In each flow path 240, a part extending from the introduction flow path 280 as an ink inlet port to an distribution flow path 250 constitutes one flow path and the distribution flow path 250 branches into bifurcation flow paths 260. The bifurcation flow paths 260 are connected to a plurality of head main bodies 110 via both the vertical flow paths 270 and the connection portions 290.

In this embodiment, a black ink Bk, a magenta ink M, a cyan ink C, and a yellow ink Y are used. The cyan ink C, the yellow ink Y, the black ink Bk, and the magenta ink M are respectively supplied from the liquid storage units (not illustrated) to the first flow path 241*a*, the first flow path 241*b*, the second flow path 242*a*, and the second flow path 242*b*. The color inks respectively flow through the first flow path 241*a*, the first flow path 241*b*, the second flow path 242*a*, and the second flow path 242*b*, and then the color inks are supplied to the head main bodies 110.

In this case, the distribution flow path 250 corresponds to a mainstream portion of the invention. However, specifically, the mainstream portion is a flow path which is interposed between two outside flow paths, out of the bifurcation flow path 260 which is located on the most upstream side and connected to the distribution flow path 250, the bifurcation flow path 260 which is located on the most downstream side, and the introduction flow path 280 which introduces liquid to the distribution flow path 250. The distribution flow path 250 may be constituted of a horizontal flow path, as described above. However, the distribution flow path 250 may be constituted of an inclined flow path. When the distribution flow path 250 is constituted of an inclined flow path, the vertical direction size of the flow path is gradually increased in accordance with an increase in the number of tributary portions. However, when the distribution flow path 250 is constituted of a horizontal flow path, as described above, there is an advantage in that the vertical-direction size of the flow path can be reduced. When the distribution flow path 250 is constituted of an inclined flow path, there is an advantage in that it is easy to process the flow path because the flow path is simply formed by opening a hole in a flow path substrate.

Furthermore, the bifurcation flow path 260, the vertical flow path 270, and the connection portion 290 correspond to tributary portions of the invention. However, the tributary portions may be constituted of horizontal flow paths or inclined flow paths, as long as the tributary portions include the vertical flow path 270. The flow paths may be provided by forming a hole in a flow path substrate. Alternatively, the flow paths may be constituted by tubes. In addition, the lengths of tributary portions may be the same or may be different from one another. The vertical flow path 270 may be a flow path extending in a vertical direction. However, the vertical flow path 270 may be a flow path which is inclined with respect to the vertical direction and allows ink to flow in the vertical direction. Such an inclined flow path is referred to as a vertical flow path extending in the vertical direction.

In the invention, the vertical flow path 270 is connected to the vertically upper portion of the manifold 95 of the head main body 110 through the connection portion 290 as an outlet port. Thus, the flow path does not extend, in the manifold 95, in the horizontal direction and the flow path is provided in the vertically upper portion of the manifold 95. Thus, it is possible to reduce the horizontal-direction size.

The tributary portion may include or may not include a horizontal flow path. Thus, the vertical flow path 270 may be directly connected to the distribution flow path 250, without the bifurcation flow path 260.

When the bifurcation flow path 260 is provided as described above, there is an advantage in that degree of freedom in the arrangement of the vertical flow path 270 is increased in terms of the relationship between the manifold 95 and the vertical flow path 270.

In this embodiment, the cross-sectional areas in the middle of the first flow path 241, the second flow path 242, and the vertical flow path 270 change, in such a manner that pressure losses in the respective vertical flow paths 270 are adjusted. Hereinafter, the configuration will be described with reference to the second flow path 242 as an specific example.

Figure 17A:
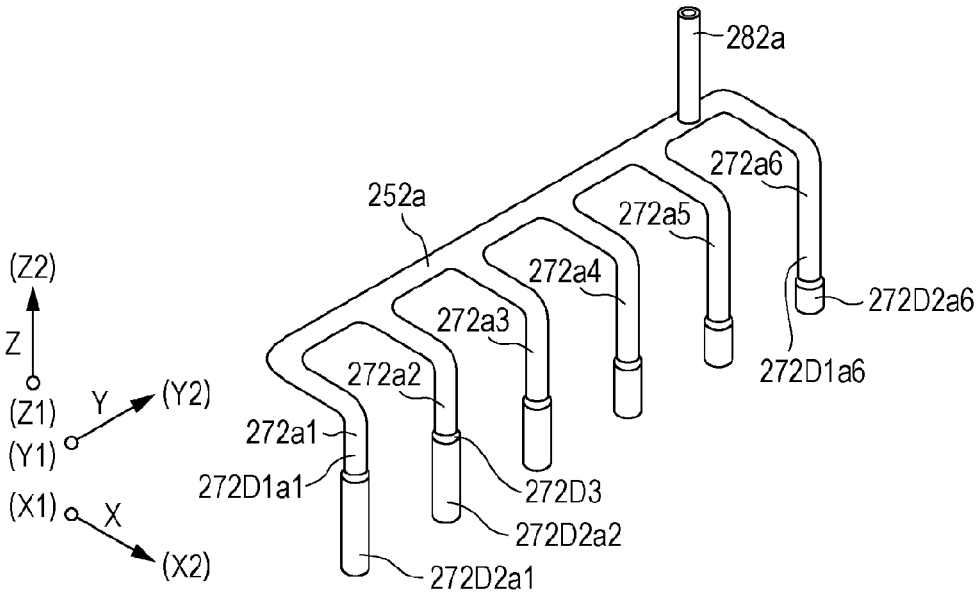
FIG. 17A illustrates a schematic perspective view of a bifurcation flow path and a vertical flow path and FIG. 17B illustrates a cross-sectional view thereof.
Figure 17B:
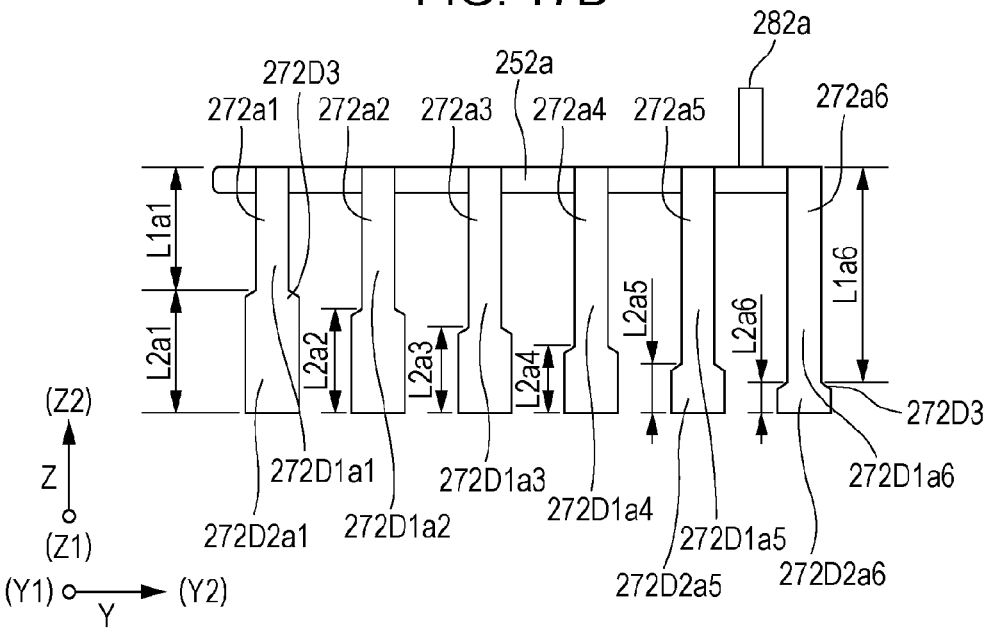

FIGS. 17A and 17B illustrate perspective views of the second vertical flow path 272. Each of the second vertical flow paths 272*a*1 to 272*a*6 is constituted of a small-diameter flow path D1, a large-diameter flow path D2, and a tapered portion D3, as illustrated in FIGS. 17A and 17B. The small-diameter flow path D1 is located on the upstream side of the second vertical flow path 272*a* and has a first cross-sectional area. The large-diameter flow path D2 is located on the downstream side of the second vertical flow path 272*a* and has a second cross-sectional area. The tapered portion D3 is located in a portion between the small-diameter flow path D1 and the large-diameter flow path D2. The cross-sectional area of the large-diameter flow path D2 is greater than that of the small-diameter flow path D1. In the second vertical flow paths 272*a*1 to 272*a*6, positions in which the cross-sectional areas change are different from one another, and thus the lengths of the small-diameter flow paths D1 and the lengths of the large-diameter flow paths D2 are different from one another. In other words, in the second vertical flow paths 272*a*1 to 272*a*6, lengths L1*a*1 to L1*a*6 of the small-diameter flow paths D1 are gradually reduced from the second vertical flow path 272*a*6 to the second vertical flow path 272*a*1. In contrast, in the second vertical flow paths 272*a*1 to 272*a*6, lengths L2*a*1 to L2*a*6 of the large-diameter flow paths D2 (which include the tapered portions D3) gradually extend from the second vertical flow path 272*a*6 to the second vertical flow path 272*a*1.

In this case, the respective groups of the second bifurcation flow paths 262*a*1 to 262*a*6 and the second vertical flow paths 272*a*1 to 272*a*6 communicate with the second distribution flow path 252*a* communicating with the second introduction flow path 282*a*. In this embodiment, both the second distribution flow path 252 and the second bifurcation flow path 262 are provided in a surface parallel to the liquid ejection surface 20*a*. However, distances from the second introduction flow path 282*a* to the respective second vertical flow paths 272*a*1 to 272*a*6 of the groups are different from one another. In such a bifurcation flow path 260 in which the distances from the introduction flow path 280 to the respective vertical flow paths 270 of the groups are different from one another, variation in pressure losses occurs in flow paths extends to the respective vertical flow paths 270. However, as described above, small-diameter flow paths 272D1 and large-diameter flow paths 272D2 are provided in the vertical flow paths 270 and the positions in which cross-sectional areas change are set to be different from one another in the respective vertical flow paths 270, in such a manner that variation in the pressure losses is adjusted in the respective flow paths. As a result, the amounts of the pressure losses can be uniformized.

In other words, since the configuration described above is applied, the pressure losses in the respective second vertical flow paths 272*a*1 to 272*a*6 are adjusted. In this embodiment, difference in supply pressure occurs inlet ports of the second vertical flow paths 272*a*1 to 272*a*6, and thus the supply pressure is gradually reduced from the second vertical flow path 272*a*6 to the second vertical flow path 272*a*1 (in other words, the pressure loss in the flow path extending to the inlet port is gradually increases). To uniformize the difference in supply pressure, the lengths L1*a*1 to L1*a*6 of the small-diameter flow paths 272D1*a*1 to 272D1*a*6 of the second vertical flow paths 272*a*1 to 272*a*6 are gradually reduced from the second vertical flow path 272*a*6 to the second vertical flow path 272*a*1, in such a manner that the pressure losses are adjusted such that the pressure losses are gradually reduced from the second vertical flow path 272*a*6 to the second vertical flow path 272*a*1. In other words, in the respective vertical flow paths 270, the positions in which the cross-sectional areas changes from the cross-sectional area of the small-diameter flow path 272D1 to the cross-sectional area of the large-diameter flow path 272D2 and the distances between the vertical flow paths 270 and the liquid ejection surface 20*a* are adjusted. Accordingly, the pressure losses in the respective flow paths are adjusted, and thus the supply pressures are substantially uniformized in the outlet ports of the respective second vertical flow paths 272*a*1 to 272*a*6.

Figure 18:
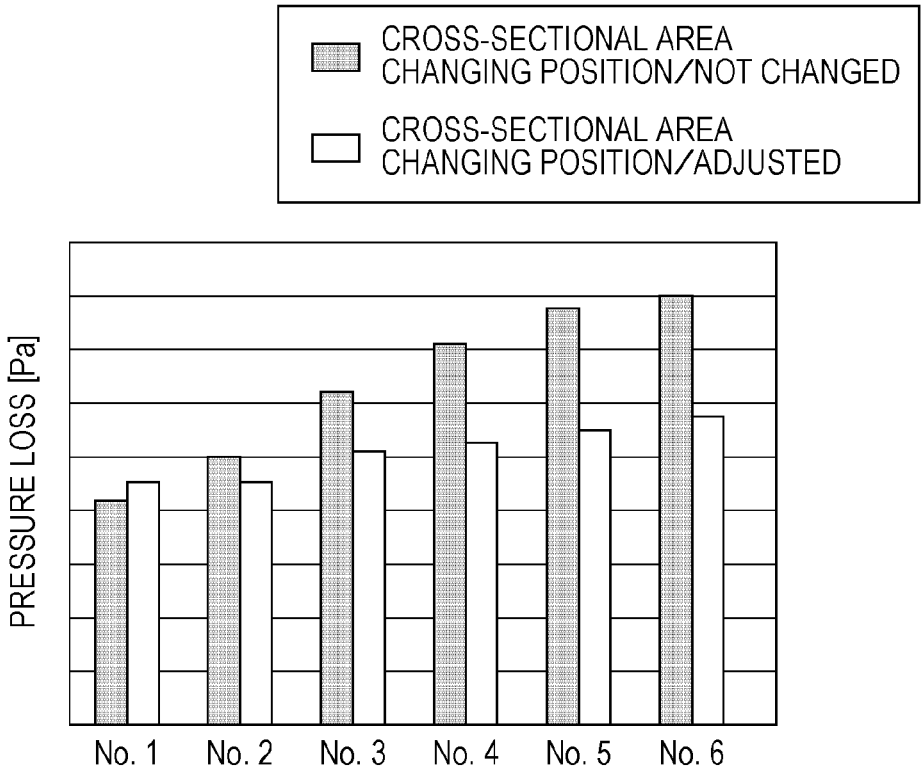
FIG. 18 is a graph illustrating the effect of the embodiment.

FIG. 18 illustrates the comparison result of pressure losses (which are the pressure losses in flow paths between the mainstream portions and the tributary portions) in the respective flow paths having such a configuration. Flow paths of No. 1 to No. 6 correspond to flow paths including the second vertical flow paths 272*a*1 to 272*a*6. In comparison targets, positions in which cross-sectional areas change are the same in the second vertical flow paths 272*a*1 to 272*a*6. As a result, it is possible to understand that differences in pressure losses in flow paths extending to the inlet ports of the respective second vertical flow paths 272*a*1 to 272*a*6 are uniformized by adjusting the positions in which the cross-sectional areas change. The first flow path portion 251, the first bifurcation flow path portion 261, and the first vertical flow path 271 of the first flow path 241 have a similar configuration.

In the illustration of FIGS. 17A and 17B, the cross-sectional area of the second distribution flow path 252 is constant. However, when it is assumed that flow rates in relation to the respective vertical flow paths 270 are set to be the same, the flow rate and the flow velocity of ink in the distribution flow path 250 change in accordance with the number of bifurcation flow paths. Accordingly, to reduce variation in flow velocities in the respective bifurcation flow paths 260 of the groups, which are connected to the distribution flow path 250, the cross-sectional area of the distribution flow path 250 is reduced in accordance with the number of distribution points, in such a manner that variation in the flow velocities may be reduced. In other words, the cross-sectional area of a part of the distribution flow path 250, which is a portion from the introduction flow path 280 to the first-branched-off bifurcation flow path 260, is set to have the maximum value and the cross-sectional area of a part of the distribution flow path 250, which is a portion to the successive-branched-off bifurcation flow path 260, is set to have a value smaller than the maximum value. Accordingly, the cross-sectional area of the distribution flow path 250 is gradually reduced in relation to the respective bifurcation flow paths 260, in such a manner that variation in the flow velocity can be reduced. Thus, variation in the flow velocity can be reduced in the respective bifurcation flow paths 260. As a result, it is possible to solve a problem that air-bubble discharge properties are deteriorated due to a reduction in flow velocity.

Figure 19:
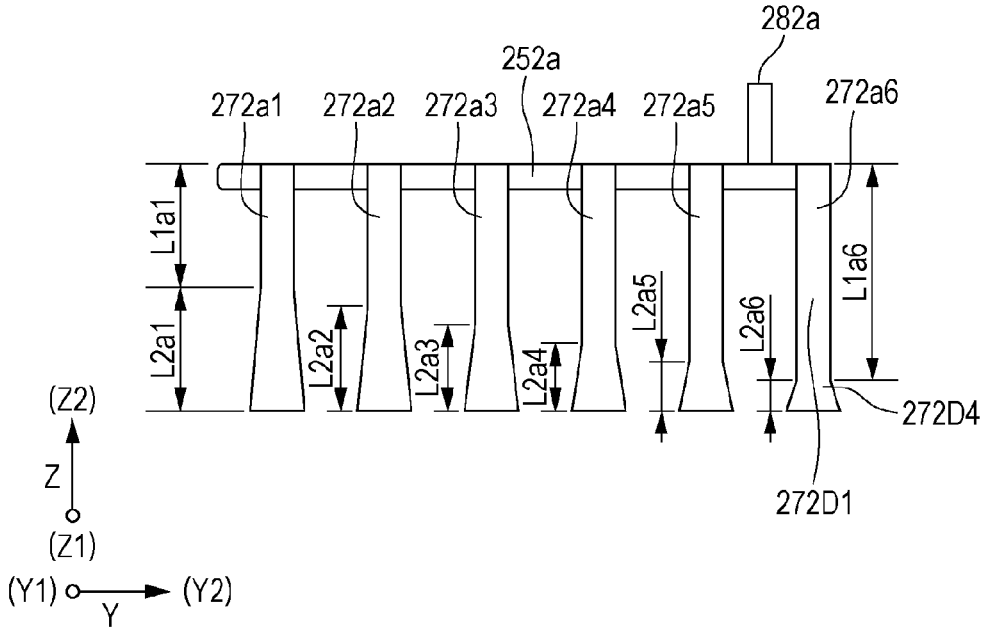
FIG. 19 is a cross-sectional view illustrating a modification example of the vertical flow path.
Figure 20:
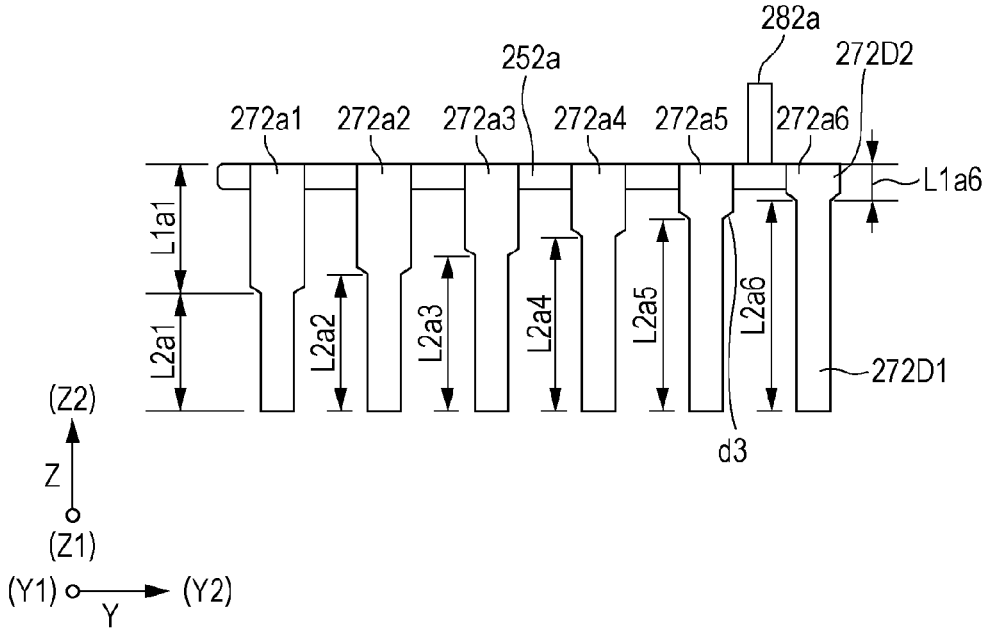
FIG. 20 is a cross-sectional view illustrating a modification example of the vertical flow path.

Here, even when the entirety of the large-diameter flow path 272D2 is constituted of a tapered flow path 272D4, both variation in the flow velocities in the respective bifurcation flow paths 260 and variation in the pressure losses in the flow paths extending to the respective bifurcation flow paths 260 can also be reduced, as illustrated in FIG. 19. Furthermore, the positional relationship between the small-diameter flow path 272D1 and the large-diameter flow path 272D2 is inverted, as illustrated in FIG. 20, the same effect can be obtained. In other words, even when the large-diameter flow path 272D2 constitutes the upstream side of the second vertical flow path 272 and the small-diameter flow path 272D1 constitutes the downstream side thereof, it is possible to obtain the same effect.

In the configurations illustrated in FIGS. 17A, 17B, and 19, the cross-sectional area of a part of the vertical flow path 270, which is a vertical flow path portion in a connection portion 275 in which the bifurcation flow path 260 constituted of a horizontal flow path changes to the vertical flow path 270, is relatively small. Accordingly, it is difficult for the flow velocity to be reduced. As a result, there is an advantage in that favorable air-bubble discharge properties is ensured in the connection portion 275. Details of the connection portion 275 will be described below. In the configuration illustrated in FIG. 20, the cross-sectional area of a flow path in the connection portion 275 is relatively large. However, there is no problem as long as air-bubble discharge properties are not deteriorated.

In the configurations illustrated in FIGS. 17A, 17B, 19, and 20, the connection portions 290 as an outlet port can have the same diameter. As a result, there is an advantage in that it is easy to connect the connection portions 290 and the manifolds 95 of the head main body 110.

In the configuration illustrated in FIGS. 17A and 17B, the tapered portion 272D3 is provided in a portion between the small-diameter flow path 272D1 and the large-diameter flow path 272D2. As a result, there is an advantage in that it is possible to remove an area in which liquid is likely to remain. However, even when the tapered portion 272D3 is not provided and the diameter of the second vertical flow path 272 is suddenly changed, there is no problem. In either configuration, there is an advantage in that it is difficult for a problem, such as dragging of air bubbles, to occur, compared to the configuration illustrated in FIG. 20.

In the configurations illustrated in FIGS. 17A, 17B, 19, and 20, the small-diameter flow paths 272D1 are aligned in the Y direction, and thus it is easy to ensure a space between adjacent small-diameter flow paths 272D1. Accordingly, there is an advantage in that a wiring substrate (that is, the COF substrate 98) connected to the head main body 110 can be disposed in a portion between adjacent vertical flow paths 270, as described below.

In the configuration described above, the positional relationships between the small-diameter flow paths 272D1 and the large-diameter flow paths 272D2 are the same in the respective flow paths. However, in the respective flow paths, the positional relationships may be different from one another.

In the configuration described above, the small-diameter flow paths 272D1 and the large-diameter flow paths 272D2 are provided in the vertical flow paths 270, in such a manner that the positions in which the diameters change are set to be different from one another, in order to uniformize difference in the pressure losses in the flow paths extending to the inlet ports of the vertical flow paths 270. However, the purpose of the configuration in which the small-diameter flow paths 272D1 and the large-diameter flow paths 272D2 are provided in the vertical flow paths 270, in such a manner that the positions in which the diameters change are set to be different from one another, is not limited thereto. The small-diameter flow paths 272D1 and the large-diameter flow paths 272D2 are provided in the vertical flow paths 270, in such a manner that positions in which the diameters change may be set to be different from one another such that, when, for example, the sizes of the manifolds 95 of the head main body 110 are different from each other, the vertical flow paths 270 correspond to the optimal supply pressures which are set to the respective vertical flow paths 270.

In the configuration described above, the small-diameter flow paths 272D1 of the flow paths have the same diameter and the large-diameter flow paths 272D2 of the flow paths have the same diameter. However, in the flow paths, the diameters may be set to be different from one another. In this case, pressure losses in the respective flow paths can be adjusted with more precision. Even in this case, it is preferable that flow paths on the outlet port sides have the same diameter because it is easy to connect the flow paths and the head main body 110, as described above.

The cross-sectional area of the vertical flow path 270 changes in the middle thereof, as described above, in such a manner that flow-path resistance of the vertical flow path 270 changes in the middle thereof. Accordingly, each vertical flow path 270 can be constituted of a flow path having a large flow-path resistance and s flow path having a small flow-path resistance. As a result, when a reduction in variation in pressure losses in the respective vertical flow paths 270 is required, it is necessary to simply set the lengths of the respective flow paths to appropriate values. Even when the number of vertical flow paths 270 increases, in the vertical flow path 270, it is necessary to simply set an approximate ratio between the length of the flow path having a large flow-path resistance and the length of the flow path having a small flow-path resistance. As a result, the radial-direction size of the flow path can be reduced, compared to in the case where the cross-sectional areas of the vertical flow paths 270 change to the same extent. Accordingly, even in the most distant tributary portion of the distribution flow path 250, which is located most far away from the introduction flow path 280, a flow path having a small cross-sectional area is provided in the vertical flow path 270, and thus favorable air-bubble discharge properties are also ensured in the vertical flow path 270. Furthermore, since the flow path having a small cross-sectional area is provided, it is easy to arrange, for example, the COF substrate 98 in a space between adjacent vertical flow paths 270 in the Y direction.

In this case, the bifurcation flow path 260 is formed in both a portion between the first flow-path member 210 and the second flow-path member 220 and a portion between the second flow-path member 220 and the third flow-path member 230, and thus the bifurcation flow path 260 is formed in a two-stage shape, as described above. Similarly, the distribution flow path 250 is formed in a two-stage shape.

Figure 21A:
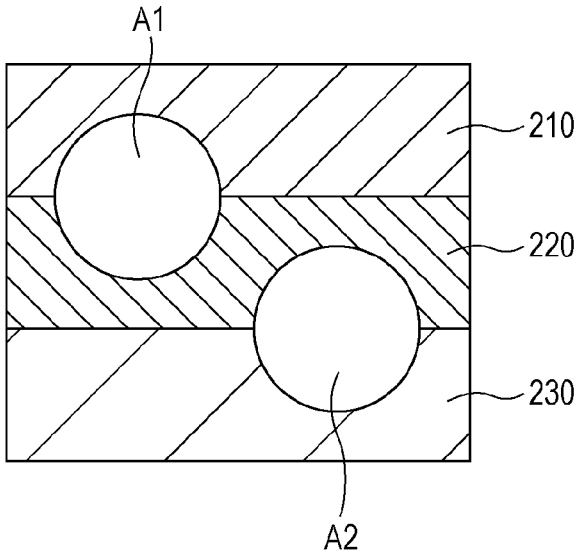
FIGS. 21A and 21B are schematic cross-sectional views illustrating the configuration of flow paths.
Figure 21B:
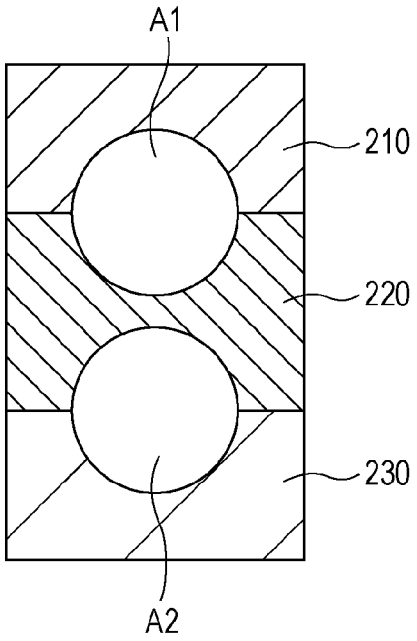

FIGS. 21A and 21B illustrate the schematic configuration of the distribution flow path 250 and the bifurcation flow path 260. In a case where a flow path A1 of a first stage and a flow path A2 of a second stage are projected onto a plane including the Z direction, when the projection images thereof do not overlap, in the plane, in a direction perpendicular to the Z direction, it is possible to reduce the vertical-direction (in other words, the thickness-direction) size of the member. When the projection images overlap each other, as illustrated in FIG. 21B, it is possible to reduce the X-direction/Y-direction (which is the width direction of the flow path) size of the member. Either configuration may be applied to the invention. Both the flow path A1 of the first stage and the flow path A2 of the second stage may be the distribution flow paths 250 or may be the bifurcation flow paths 260.

In the four flow paths 240 described above, in the flow paths A1 of the first stage and the flow paths A2 of the second stage, the distances from the inlet ports of the introduction flow paths 280 to the distribution flow paths 250 are different from each other. Thus, variation in the pressure losses occurs in the flow paths. It is preferable that, in a portion between the flow path A1 of the first stage and the flow path A2 of the second stage, the diameter of the introduction flow path 280 and the cross-sectional area of a part of the distribution flow path 250, which is the portion extending to the intersection portion 410, change, in order to reduce the variation in the pressure losses. Specifically, since the distance between the inlet port of the introduction flow path 280 of the flow path A2 of the second stage and the distribution flow path 250 thereof are longer than that of the flow path A1 of the first stage, the cross-sectional area of a part of the first flow path 241, which is the portion extending to the intersection portion 410 of the first flow path portion 251 may be set to be greater than the cross-sectional area of the second flow path 242, which is the portion extending to the intersection portion 410 of the second distribution flow path 252. Furthermore, it is preferable that, to flow air bubbles downward, the size of the introduction flow path 280 is reduced as much as possible. It is preferable that the cross-sectional area of the introduction flow path 280 is set to the value smaller than the minimum value of the cross-sectional area of the distribution flow path 250.

In either configuration, the bifurcation flow path 250 of the this embodiment extends in the horizontal direction and is formed in a two-stage shape, in a state where the distribution flow path 250 is formed in both the portion between the first flow-path member 210 and the second flow-path member 220 as the flow-path member 200 and the portion between the second flow-path member 220 and the third flow-path member 230 as the flow-path member 200. Similarly, the distribution flow path 260 is formed in a two-stage shape. The vertical flow paths 270 are aligned in the horizontal direction, in the first flow-path member 210, the second flow-path member 220, and the third flow-path member 230 as the flow-path member 200. In other words, the flow-path member 200 shared in common to the bifurcation flow paths 260 corresponds to a vertical flow-path forming member of the invention. Tributary portions corresponding to six head main bodies 110 are formed in the flow-path member 200.

The six head main bodies 110 are connected to the third flow-path member 230. In addition, the connection portions 290 are connected to the manifolds 95. Four manifolds 95 are provided to each of the six head main bodies 110, and thus, in total, twenty-four manifolds 95 are provided in the six head main bodies 110. In other words, the third flow-path member 230 corresponds to an outlet-port forming member of the invention, which is shared in common to the six head main bodies 110. When such a common outlet-port forming member is provided, there is an advantage in that it is easy to fix the flow-path forming member to the plurality of head main bodies 110, compared to in the case where outlet-port forming members are separately provided corresponding to the respective head main bodies 110 having the manifolds 95.

A member which forms the manifold 95 of the head main body 110 may be directly fixed to the third flow-path member 230 in which the outlet ports are formed, as described above. However, another member may be interposed therebetween.

In addition, the opening portion 201 is provided in the flow-path member 200. The COF substrate 98 provided in the head main body 110 is inserted through the opening portion 201. In this embodiment, the first opening portion 215 is provided in the first flow-path member 210. The first opening portion 215 is inclined with respect to the Z direction and passes through the first flow-path member 210. The second opening portion 225 is provided in the second flow-path member 220 and the second opening portion 225 is inclined with respect to the Z direction and passes through the second flow-path member 220. The third opening portion 235 is provided in the third flow-path member 230. The third opening portion 235 is inclined with respect to the Z direction and passes through the third flow-path member 230.

The first opening portion 215, the second opening portion 225, and the third opening portion 235 communicate with one another, in such a manner that one opening portion 201 is formed. The opening portion 201 has an opening shape extending in the Xa direction. Six opening portions 201 are aligned in the Y direction.

In this case, The COF substrate 98 according to this embodiment includes a lower end portion 98*c* and an upper end portion 98*d*, as illustrated in FIG. 16. The lower end portion 98*c* is one end portion of the COF substrate 98, which is close, in the Z direction, to the head main body 110. The upper end portion 98*d* is the other end portion of the COF substrate 98, which is away, in the Z direction, from the head main body 110. The width of the upper end portion 98*d* in the Xa direction is smaller than the width of the lower end portion 98*c* in the Xa direction. In other words, in the flexible wiring substrate 98, the plane-direction width of the one end portion is smaller than that of the one end portion.

In this embodiment, a part of the COF substrate 98, which is inserted through the first opening portion 215, and a part of the COF substrate 98, which is inserted through the third opening portion 235, have a rectangular shape of which the Xa-direction width is constant. A part of the COF substrate 98, which is inserted through the second opening portion 225, has a trapezoidal shape of which the Xa-direction width is reduced as the part of the COF substrate 98 extends from the Z1 side to the Z2 side.

Meanwhile, the opening portion 201 of the flow-path member 200 has a first opening 236 (in other words, the Z1-side opening of the third opening portion 235) and a second opening 216 (in other words, the Z2-side opening of the first opening portion 215). In the Z direction perpendicular to the liquid ejection surface 20*a*, the first opening 236 is close to the head main body 110 and the second opening 216 is away from the head main body 110.

The size of the second opening 216 in the Xa direction is smaller than the size of the first opening 236 in the Xa direction. In other words, the width of the opening portion 201 in the Xa direction is reduced as the opening portion 201 extends from the Z1 side to the Z2 side in the Z direction. Specifically, the opening portion 201 has a shape allowing the COF substrate 98 to be accommodated therein. The width of the opening portion 201 in the Xa direction is slightly greater than the width of the COF substrate 98 in the Xa direction.

The first opening portion 215 of the first flow-path member 210, the second opening portion 225 of the second flow-path member 220, and the third opening portion 235 of the third flow-path member 230 are provided in a space between adjacent vertical flow paths 270 in the Y direction. Particularly, a space between adjacent small-diameter flow paths 272D1 of the vertical flow paths 270 is relatively increased, and thus it is possible to relatively easily provide, in the space, the first opening portion 215, the second opening portion 225, and the third opening portion 235.

Figure 22:
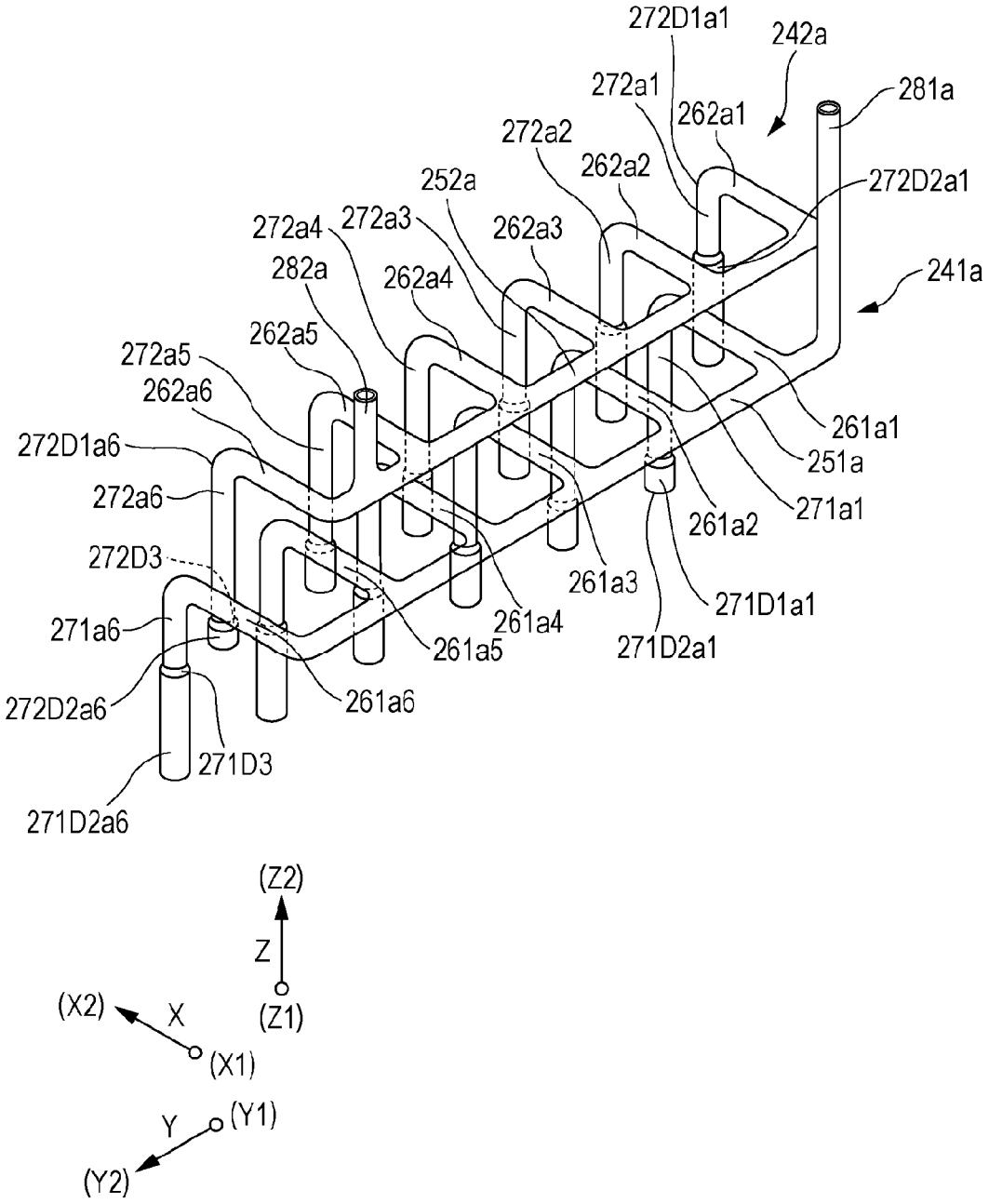
FIG. 22 is a schematic perspective view illustrating the bifurcation flow path, the vertical flow path, and the distribution flow path.

FIG. 22 illustrates the schematic perspective view of the distribution flow path 250, the bifurcation flow path 260, and the vertical flow path 270 of this embodiment. In this embodiment, the distribution flow path 250 extends in the horizontal direction and is formed in a two-stage shape, as illustrated in FIG. 22. The vertical flow paths 270 are aligned in the horizontal direction.

The respective second vertical flow paths 272*a*1 to 272*a*6 are constituted of the small-diameter flow paths 272D1, the large-diameter flow paths 272D2, and the tapered portions 272D3, as described above. The small-diameter flow path 272D1 is located on the upstream side of the second vertical flow path and has a first cross-sectional area. The large-diameter flow path 272D2 is located on the downstream side of the second vertical flow path and has a second cross-sectional area. The tapered portion 272D3 is located in a portion between the small-diameter flow path 272D1 and the large-diameter flow path 272D2. The cross-sectional area of the large-diameter flow path 272D2 is set to be greater than that of the small-diameter flow path 272D1. In the second vertical flow paths 272*a*1 to 272*a*6, positions in which the cross-sectional areas change are different from one another, and thus the lengths of the respective small-diameter flow paths 272D1*a*1 to 272D1*a*6 and the lengths of the large-diameter flow paths 272D2*a*1 to 272D2*a*6 are different from one another. In other words, the lengths of the respective small-diameter flow paths 272D1*a*1 to 272D1*a*6 and the lengths of the large-diameter flow paths 272D2*a*1 to 272D2*a*6 are appropriately set in accordance with the distances between the second introduction flow path 282*a* connected to the second distribution flow path 252*a* and the respective second vertical flow paths 272*a*1 to 272*a*6. The second vertical flow paths 272*b*1 to 272*b*6 have a similar configuration to that described above.

Furthermore, similarly to the second vertical flow path 272, the respective first vertical flow paths 271*a*1 to 271*a*6 are constituted of the small-diameter flow paths 271D1, the large-diameter flow paths 271D2, and the tapered portions 271D3, as described above. The small-diameter flow path 271D1 is located on the upstream side of the first vertical flow path and has a first cross-sectional area. The large-diameter flow path 271D2 is located on the downstream side of the first vertical flow path and has a second cross-sectional area. The tapered portion 272D3 is located in a portion between the small-diameter flow path 271D1 and the large-diameter flow path 271D2. The cross-sectional area of the large-diameter flow path 271D2 is set to be greater than that of the small-diameter flow path 271D1. In the first vertical flow paths 271*a*1 to 271*a*6, positions in which the cross-sectional areas change are different from one another, and thus the lengths of the respective small-diameter flow paths 272D1 and the lengths of the large-diameter flow paths 272D2 are different from one another. In other words, the lengths of the respective small-diameter flow paths 271D1*a*1 to 271D1*a*6 and the lengths of the large-diameter flow paths 271D2*a*1 to 271D2*a*6 are appropriately set in accordance with the distances between the first introduction flow path 281*a* connected to the first distribution flow path 251*a* and the respective first vertical flow paths 271*a*1 to 271*a*6. Specifically, the lengths L1*a*1 to L1*a*6 of the small-diameter flow paths 271D1*a*1 to 271D1*a*6 of the first vertical flow paths 271*a*1 to 271*a*6 are gradually reduced from the first vertical flow path 271*a*1 to the first vertical flow path 271*a*6. In contrast, lengths L2*a*1 to L2*a*6 of the large-diameter flow paths (which include the tapered portions D3) 271D2*a*1 to 271D2*a*6 of the first vertical flow paths 271*a*1 to 271*a*6 gradually increase from the first vertical flow path 271*a*1 to the first vertical flow path 271*a*6.

The distribution flow path 250 and the bifurcation flow path 260 are provided in a plane parallel to the liquid ejection surface 20*a*, as described above. Furthermore, the distribution flow path 250 is formed in a two-stage shape in the vertical direction and the bifurcation flow path 260 is formed in a two-stage shape in the vertical direction. In addition, the vertical flow paths 270 connected to the bifurcation flow paths 260 are aligned in the horizontal direction. As a result, a plurality of flow paths can be provided in a common flow-path member 200, with high efficiency.

In the first vertical flow paths 271*a*1 to 271*a*6 which branch off from the first flow path portion 251 having a two-stage shape and the second vertical flow paths 272*a*1 to 272*a*6 which branch off from the second distribution flow path 252 having a two-stage shape, the first vertical flow path 271*a*1 and the second vertical flow path 272*a*6, for example, are respectively connected to two manifolds 95 of one head main body 110. Furthermore, the first vertical flow path 271*a*6 and the second vertical flow path 272*a*1 are respectively connected to two manifolds 95 of the other head main body 110. Accordingly, it is preferable that at least supply pressures of outlet ports of the vertical flow paths 270 connected to one head main body 110 are set to be uniform. Furthermore, when the types of the six head main bodies 110 are the same, it is preferable that supply pressures of the outlet ports of all of the vertical flow paths 270 are set to be uniform. Needless to say, when the types of the head main bodies 110 are different from each other, the pressure losses in the vertical flow paths 270 are adjusted such that the supply pressures become desired values.

In the embodiment described above, it is preferable that the minimum value of the flow path resistance of the distribution flow path 250, which is the value per unit distance, is smaller than the minimum value of the flow path resistance of each bifurcation flow path 260, which is the value per unit distance. Furthermore, it is preferable that the minimum value of the flow path resistance of the distribution flow path 250 is smaller than the minimum value of the flow path resistance of each bifurcation flow path 270, which is the value per unit distance. In other words, the minimum value of the flow path resistance of the distribution flow path 250 may be set, with respect to all of the bifurcation flow paths 260 and the vertical flow paths 270, to be smaller than the minimum value of the flow path resistance of each bifurcation flow path 260 or each vertical flow path 270. In this case, the flow path resistance of the distribution flow path 250 is small, as described above. Thus, even when the number of bifurcation flow paths 260 and the number of the vertical flow paths 270 increase, it is possible to reduce variation in pressure losses in the bifurcation flow path 260 and the vertical flow path 270, compared to in the case where such a relationship is not satisfied.

Furthermore, it is preferable that the respective minimum values of the cross-sectional areas of each bifurcation flow path 260 and each vertical flow path 270 are smaller than the minimum value of the cross-sectional area of the distribution flow path 250. In other words, in any bifurcation flow paths 260 and the vertical flow paths 270, it is preferable that the respective minimum values of the cross-sectional areas of the bifurcation flow path 260 and the vertical flow path 270 are smaller than the minimum value of the cross-sectional area of the distribution flow path 250. In this case, it is possible to increase the flow velocity of liquid in the bifurcation flow path 260 and the vertical flow path 270. As a result, it is possible to improve air-bubble discharge properties.

Furthermore, it is preferable that the minimum value of the cross-sectional area of the distribution flow path 250 is equal to or greater than the respective maximum values of the cross-sectional areas of each bifurcation flow path 260 and each vertical flow path 270. In other words, it is preferable that the minimum value of the cross-sectional area of the distribution flow path 250 is set, with respect to all of the bifurcation flow paths 260 and the vertical flow paths 270, to be greater than the respective maximum values of the cross-sectional areas of each bifurcation flow path 260 and each vertical flow path 270. In this case, the flow path resistance of the distribution flow path 250 is set to an adequately small value. Thus, even when the number of the bifurcation flow paths 260 and the number of vertical flow paths 270 increase, it is possible to reduce variation in the pressure losses in the bifurcation flow path 260 and the vertical flow path 270.

In addition, it is preferable that the cross-sectional area of the connection portion 290 as an outlet port is smaller than the maximum value of the cross-sectional area of the distribution flow path 250. Furthermore, it is preferable that the cross-sectional area of the connection portion 290 is greater than the respective minimum values of the cross-sectional areas of each bifurcation flow path 260 and each vertical flow path 270. In this case, in a plurality of bifurcation flow paths 260 and the vertical flow paths 270, the cross-sectional areas of the connection portions 290 which are outlet ports of the bifurcation flow path 260 and the vertical flow path 270 satisfy such a relationship. Thus, it is possible to reduce variation in the flow velocity in the flow paths, compared to in the case where the relationship mentioned above is not satisfied. In addition, the diameters of head-main-body-side ports connected to outlet ports can be set to the same, in relation to the respective head main bodies. As a result, it is easy to assemble the members.

Embodiment 2

In the embodiment described above, pressure-loss adjustment is performed in each tributary portion of the vertical flow path 270. However, the bifurcation flow path 260 may have a structure capable of performing pressure-loss adjustment. The other members have the same configuration as those of the members of the embodiment described above. Thus, descriptions thereof will not be repeated.

Here, details of a connection portion between the bifurcation flow path 260 and the vertical flow path 270 will be described with reference to FIG. 23.

The bifurcation flow path 260 extends in a direction intersecting the vertical flow path 270 extending in the vertical direction. In this embodiment, the bifurcation flow path 260 extends in a surface parallel to the liquid ejection surface 20*a*. In a case where a portion in which the extended flow path of the bifurcation flow path 260 intersects the extended flow path of the vertical flow path 270 is set to the connection portion 275, when the shape of a surface of the connection portion 275, which is the surface on the upper side in the vertical direction, is formed as follows, in a plan view of a cross-sectional area including both the extension direction of the bifurcation flow path 260 and the extension direction of the vertical flow path 270. In the upper side of the connection portion 275 in the vertical direction, a connection surface 401 connecting the surface of the bifurcation flow path 260 and the surface of the vertical flow path 270 is curved. The reason for this is that it is easy for air bubbles 403 to flow along the connection surface 401 on the upper side of the connection portion 275 in the vertical direction, and thus the air bubbles 403 is prevented from remaining in the upper side of the connection portion 275 in the vertical direction. Furthermore, the shape of the upper-side surface of the connection portion 275 in the vertical direction is not limited to a curved shape. The upper-side surface of the connection portion 275 may be constituted of, for example, an inclined surface or a plurality of connected inclined surfaces (in other words, the upper-side surface may be formed in a polygonal shape), as long as it can prevent the air bubbles 403 from remaining. The upper-side surface of the connection portion 275 may be constituted of a surface which intersects both the surface of the bifurcation flow path 260 and the surface of the vertical flow path 270, at an angle greater than an angle 402 between an imaginary line extending in the extension direction of the bifurcation flow path 260 and an imaginary line extending in the extension direction of the vertical flow path 270.

Although the configuration is not described in Embodiment 1, it is shared in common to Embodiments 1 and 2.

In the bifurcation flow path 260, the intersection portion 410 is provided in the vicinity of the vertical flow path 270. The intersection portion 410 is an area which extends from a start position 411 to an end position 412, in the flowing direction of ink in the bifurcation flow path 260. The intersection portion 410 of this embodiment includes an intersection surface 415 constituted of an inclined surface. Such an intersection surface 415 is provided in the intersection portion 410, in such a manner that the cross-sectional area of the flow path is gradually reduced as the flow path extends to the downstream side, toward the connection portion 275. Therefore, the flow velocity gradually increases, and thus flowing of air bubbles in the connection portion 275 is promoted. As a result, it is possible to prevent the air bubbles 403 from remaining.

When the intersection portion 410 is provided in the first bifurcation flow path portion 261, the Z-direction depth of the branch groove portions 232*a* and 232*b* in the Z2-side surface of the third flow-path member 230 may be gradually reduced as the branch groove portions extend from a side in which the branch groove portions 232*a* and 232*b* respectively communicate with the distribution groove portions 231*a* and 231*b* to a side in which the openings of the through-hole portions of the first vertical flow paths 271 are provided. Specifically, on a side in which the branch groove portions 232*a* and 232*b* respectively communicate with the distribution groove portions 231*a* and 231*b*, the Z-direction depth of the branch groove portions 232*a* and the 232*b* on the Z2-side surface of the third flow-path member 230 may be set to the same value as that of the distribution groove portions 231*a* and 231*b*. On a side in which the openings of the through-hole portions of the first vertical flow paths 271 are provided, the depth of the branch groove portions 232*a* and 232*b* may be set to the value smaller than that of the distribution groove portions 231*a* and 231*b*. When the intersection portion 410 is provided in the second bifurcation flow path 262, a similar configuration to that described above may be applied to second flow-path member 220, instead of the third flow-path member 230. The intersection portion 410 is provided on, particularly, a lower side in the vertical direction, in such a manner that flowing of ink to the connection surface 401 is promoted on the upper side of the connection portion 275 in the vertical direction. Accordingly, the air bubbles 403 flow to the vertical flow path 270, along the connection surface 401 of the connection portion 275, which is located on the upper side in the vertical direction. As a result, it is possible to prevent the air bubbles 403 from remaining.

Furthermore, it is preferable that the cross-sectional area of the vertical flow path 270 is smaller than that of the bifurcation flow path 260. In this case, the flow velocity of ink the vertical flow path 270 increases, and thus it is possible to effectively flow the air bubbles 403 to the lower side in the vertical direction. In addition, it is preferable that the cross-sectional area of the vertical flow path 270 is smaller than the cross-sectional area of a part of the bifurcation flow path 260, which is the portion extending from the intersection portion 410 to the connection portion 275. In this case, the flow velocity of ink the vertical flow path 270 increases, and thus it is possible to effectively flow the air bubbles 403 to the lower side in the vertical direction.

For example, the inclination angle or the length of the inclined surface of the intersection surface 415 is appropriately set, in such a manner that it is possible to increase the flow velocity and, further, it is possible to adjust the degree of reduction in pressure loss and discharge properties of the air bubbles 403.

The configuration of the intersection surface 415 is not limited to the configuration in which the intersection surface 415 is constituted of an inclined surface 415A. The intersection surface 415 may be constituted of a stepped surface, as illustrated in FIG. 24. However, when the intersection surface 415 is constituted of an inclined surface, as illustrated in FIG. 23, it is possible to prevent air bubbles from remaining in the intersection surface 415.

Furthermore, any configuration can be applied to the intersection portion 410, as long as it can change the cross-sectional area of the flow-path. Thus, the cross-sectional area of the intersection portion 410 may change by changing the width (which is the size of the flow path in a direction perpendicular to the paper of FIG. 23) of the flow path.

In other words, it is preferable that the intersection surface 415 is provided on the lower side of the bifurcation flow path 260 in the vertical direction. However, the intersection surface 415 may be provided on the upper side or a side surface of the bifurcation flow path 260. However, when the intersection surface 415 is provided on the lower side of the bifurcation flow path 260, as in the case of this embodiment, the flow passing through the intersection portion 410 is directed to the connection surface 401. Thus, even when the air bubbles 403 are located in the vicinity of the connection surface 401, the air bubbles 403 can be reliably discharged by the flow passing the intersection portion 410. Furthermore, it is not necessary to increase/decrease the width of the flow path in a direction perpendicular to the paper of FIG. 23, in order to increase/decrease the cross-sectional area. Thus, when a plurality of flow paths are aligned in the direction perpendicular to the paper of FIG. 23, there is an advantage in that a gap between adjacent flow paths can be reduced. In other words, in the first bifurcation flow path portions 261*a*1 to 261*a*6, a Y-direction gap between adjacent flow paths can be reduced. Similarly, a Y-direction gap between adjacent flow paths of the other bifurcation flow paths 260 can be reduced.

Furthermore, since such an intersection portion 410 is provided, it is possible to reduce the pressure loss in the flow path extending to the intersection portion 410, as small as possible. As a result, it is possible to reduce the entirety of pressure losses. In other words, In the distribution flow path 250 and the bifurcation flow path 260, the pressure losses in the flow paths extending to the intersection portions 410 are reduced as small as possible and the air-bubble discharge properties in the connection portions 275 are improved by increasing the flow velocity in the intersection portions 410. As a result, both a reduction in pressure loss and favorable air-bubble discharge properties are obtained in the entirety of the flow paths.

In this embodiment, six groups of the bifurcation flow paths 260 and the vertical flow paths 270 are provided in one flow path 240, as described above. The distances from the introduction flow path 280 to the vertical flow paths 270 of the respective groups are different from each other. FIG. 22 illustrates a schematic perspective view of both the first flow path 241*a* and the second flow path 242*a* of the flow path 240.

The respective groups of the first bifurcation flow path portions 261*a*1 to 261*a*6 and the first vertical flow paths 271*a*1 to 271*a*6 communicate with the first distribution flow path 251*a* communicating with the first introduction flow path 281*a*, as illustrated in FIG. 22 which is referred to in Embodiment 1. Furthermore, the distances from the first introduction flow path 281*a* to the respective first vertical flow paths 271*a*1 to 271*a*6 of the groups are different from each other. Furthermore, the respective groups of the second bifurcation flow paths 262*a*1 to 262*a*6 and the second vertical flow paths 272*a*1 to 272*a*6 communicate with the second distribution flow path 252*a* communicating with the second introduction flow path 282*a*. In addition, the distances from the second introduction flow path 282*a* to the respective second vertical flow paths 272*a*1 to 272*a*6 of the groups are different from each other.

In the bifurcation flow paths 260 having a configuration in which the distances from the introduction flow path 280 to the respective vertical flow paths 270 of the groups are different from each other, variation in pressure losses occur in portions extending to the intersection portions 410. However, the degree of intersection between the intersection surface 415 and the start position 411 and/or the end position 412 of the intersection portion 410 changes, in such a manner that the air-bubble discharge properties and the degree of reduction in the pressure loss in the intersection portion 410 can change. As a result, it is possible to reduce variation in the pressure losses in the bifurcation flow paths 260.

Figure 25A:
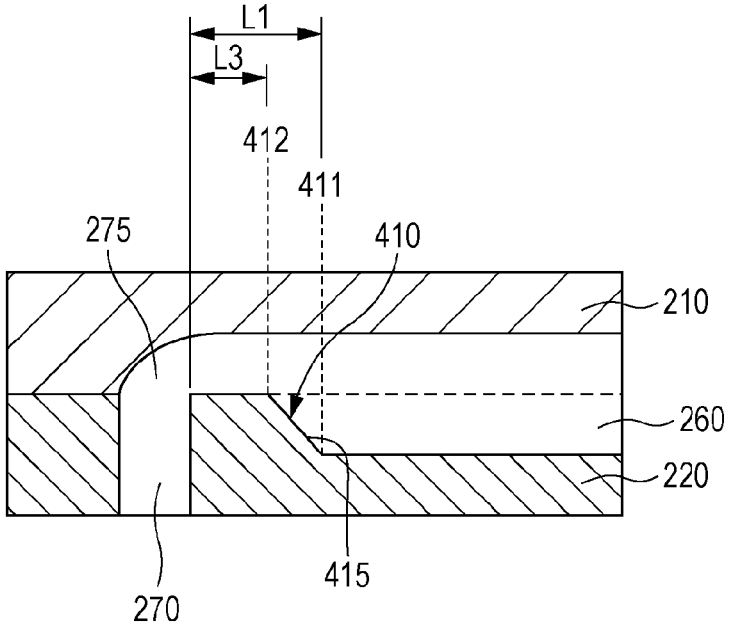
FIGS. 25A and 25B are schematic cross-sectional views illustrating the bifurcation flow path and the vertical flow path of Embodiment 2.
Figure 25B:
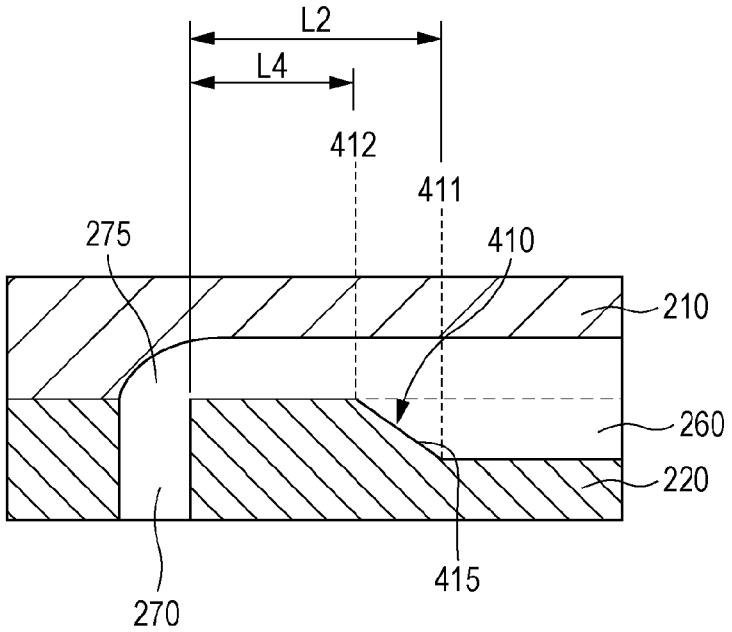

FIGS. 25A and 25B schematically illustrate such an example.

In a plurality of bifurcation flow paths 260 having a configuration in which, for example, the distances from the introduction flow path 280 to the respective vertical flow paths 270 are different from each other, the amount of the pressure loss in the distant bifurcation flow path 260 is greater than that of the close bifurcation flow path 260, as illustrated in FIGS. 25A and 25B. In this case, to reduce variation in the pressure losses in the bifurcation flow paths 260, the intersection portions 410 may be provided in the distant bifurcation flow path 260 and the close bifurcation flow path 260, in a state where a distant L1 (see FIG. 25A) from the start position 411 of the intersection portion 410 of the distant bifurcation flow path 260 to the vertical flow path 270 is set to be smaller than a distant L2 (see FIG. 25B) from the start position 411 of the intersection portion 410 of the close bifurcation flow path 260 to the vertical flow path 270. In other words, the intersection portions 410 are provided in the bifurcation flow paths 260, in a state where the relationship of L1<L2 is satisfied.

Alternatively, the intersection portions 410 may be provided in the distant bifurcation flow path 260 and the close bifurcation flow path 260, in a state where a distant L3 (see FIG. 25A) from the end position 412 of the intersection portion 410 of the distant bifurcation flow path 260 to the vertical flow path 270 is set to be smaller than a distant L4 (see FIG. 25B) from the end position 412 of the intersection portion 410 of the close bifurcation flow path 260 to the vertical flow path 270. In other words, the intersection portions 410 are provided in the bifurcation flow paths 260, in a state where the relationship of L3<L4 is satisfied.

Figure 23:
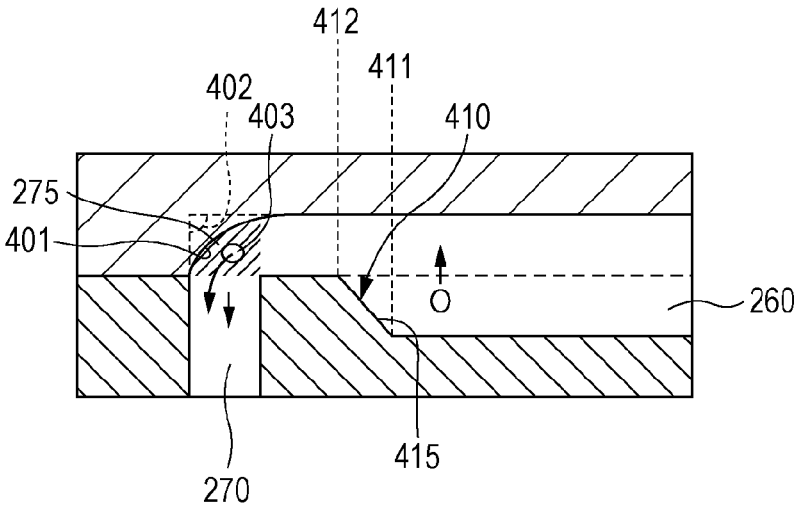
FIG. 23 is a schematic cross-sectional view illustrating a bifurcation flow path and a vertical flow path of Embodiment 2.
Figure 24:
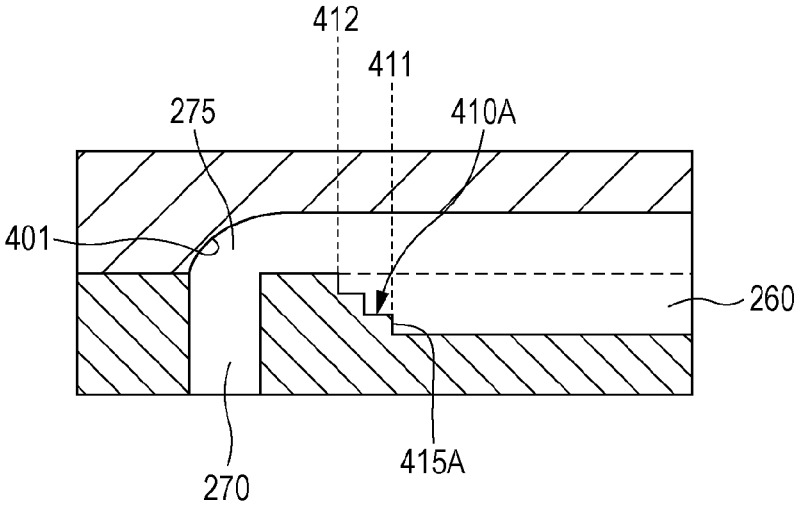
FIG. 24 is a cross-sectional view illustrating a modification example of an intersection portion of Embodiment 2.
Figure 26:
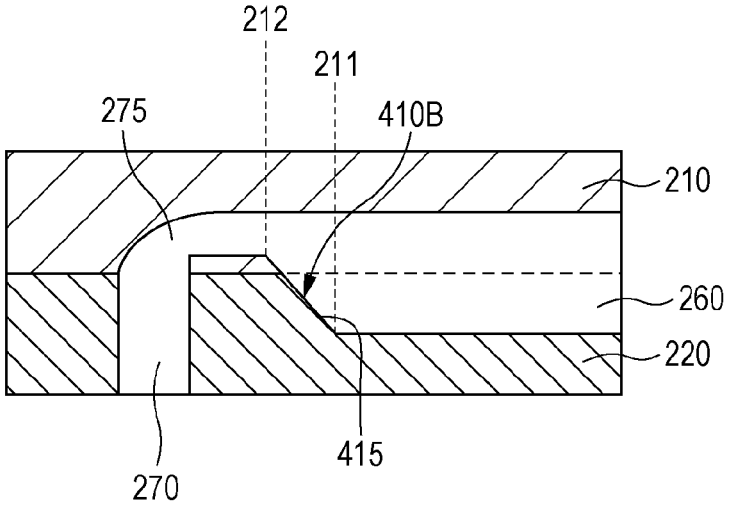
FIG. 26 is a cross-sectional view illustrating a modification example of the intersection portion of Embodiment 2.

The second bifurcation flow path 262 is formed in the boundary surface between the first flow-path member 210 and the second flow-path member 220, as illustrated in FIG. 23. However, it is preferable that the end position 412 of the intersection portion 410 is formed by only the second flow-path member 220, without using the first flow-path member 210 and other members. In other words, when an intersection portion 410B of which the end position 412 is located on the side of the first flow-path member 210 is provided, as illustrated in FIG. 26, the intersection portion 410B cannot be formed by only the branch groove portions 223*a*, 223*b*, 232*a*, and 232*b* in the first flow-path member 210. Thus, it is necessary to provide a through-hole which passes through the first flow-path member 210, in a direction perpendicular to the Z direction. As a result, it is difficult to perform processing. Although not illustrated, a configuration in which an intersection portion is formed by the first flow-path member 210 and other members is unpreferable in terms of processing. This situation is shared by the first bifurcation flow path portion 261 which is formed in the boundary surface between the second flow-path member 220 and the third flow-path member 230.

Figure 27:
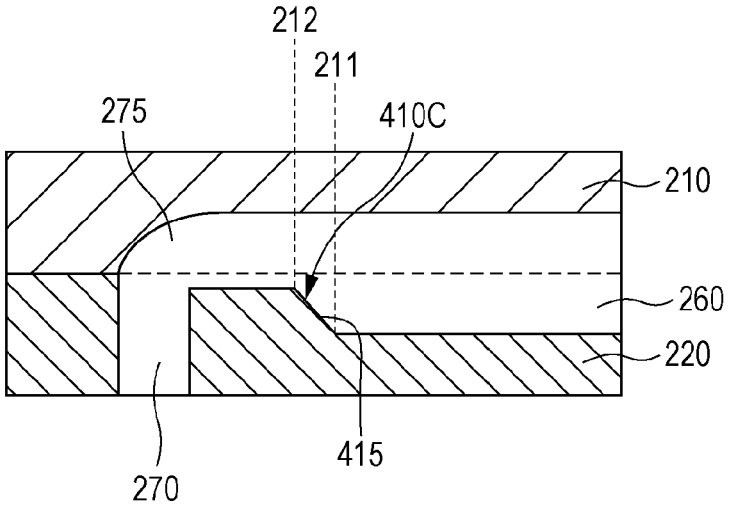
FIG. 27 is a cross-sectional view illustrating a modification example of the intersection portion of Embodiment 2.

It is more preferable that an intersection portion 410C of the second bifurcation flow path 262 is formed by only the first flow-path member 210, as illustrated in FIG. 27, and the end position 412 of the intersection portion 410C is located further on the side of the second flow-path member 220 than the boundary surface between the first flow-path member 210 and the second flow-path member 220. In other words, a part of the intersection portion 410C, which is a portion deciding the cross-sectional area of the flow path, may be located further on the side of the second flow-path member 220 than the boundary surface between the first flow-path member 210 and the second flow-path member 220. When the end position 412 is located in the boundary surface between the first flow-path member 210 and the second flow-path member 220, it is difficult to manage an adhesion surface (in other words, it is difficult to manage surface roughness and a reference surface). When the configuration described above is not applied to the invention, the following problem is caused. When an adhesion surface is processed with relatively higher precision, compared to a flow path surface, the adhesion surface and the flow path surface are located, in the same plane, close to each other. As a result, management of both surfaces is complicated, and thus there is a problem in that it is difficult to perform processing. Accordingly, it is preferable that the intersection portion 410C of the second bifurcation flow path 262 is formed by only the first flow-path member 210, as illustrated in FIG. 27. This situation is shared by the first bifurcation flow path portion 261 which is formed in the boundary surface between the second flow-path member 220 and the third flow-path member 230.

Other Embodiments

Hereinbefore, the embodiments of the invention are described. However, the basic configuration of the invention is not limited thereto.

In the recording head 100 according to Embodiment 1 or 2, the first flow path 241 and the second flow path 242 are provided and the first distribution flow path 251 and the second distribution flow path 252 are located at different positions in the Z direction. However, the configuration is not limited thereto. A recording head may include a flow-path member in which flow paths parallel to the liquid ejection surface 20*a* are provided in, for example, only the same plane. According to the embodiment described above, a recording head may have a configuration in which only second flow path is provided in a flow-path member including the first flow-path member 210 and the second flow-path member 220. In the case of the recording head in which either the first flow path 241 or the second flow path 242 is not provided, as described above, the Z-direction size of the recording head 100 can be reduced.

The second flow path 242 is formed by causing the first flow-path member 210 and the second flow-path member 220 to adhere to each other and the first flow path 241 is formed by causing the second flow-path member 220 and the third flow-path member 230 to adhere to each other. However, the method of forming the first flow path 241 and the second flow path 242 is not limited thereto. The first flow path 241 and the second flow path 242 may be integrally formed, without causing two or more flow-path member to adhere to each other, by a lamination forming method allowing three-dimensional forming. Alternatively, each flow-path member may be formed by three-dimensional forming, molding (for example, injection molding), cutting, pressing.

The flow-path member 200 has, as the first flow path 241, two flow paths which are the first flow path 241*a* and the first flow path 241*b*. However, the number of first flow paths is not limited thereto. One first flow path may be provided or three or more first flow paths may be provided. The second flow path 242 has a similar configuration to that described above.

The first distribution flow path 251*a* branches into the six first bifurcation flow paths 261*a*. However, the configuration is not limited thereto. The first distribution flow path 251*a* may be connected to one head main body 110, without being branched. The number of branched-off flow paths is not limited to six and may be two or more. The first distribution flow path 251*b*, the second distribution flow path 252*a*, and the second distribution flow path 252*b* have a similar configuration to that described above.

The cross-sectional area of the distribution flow path 250 is reduced in accordance with the number of distribution points. However, the cross-sectional area of the distribution flow path 250 may not be reduced and be constant. Furthermore, in the flow path A1 of the first stage and the flow path A2 of the second stage, the diameters of the introduction flow paths 280 are set to be different from each other and, further, the cross-sectional areas of parts of the distribution flow paths 260, which are the portions extending to the intersection portions 410, are set to be different from each other. However, in the flow path A1 of the first stage and the flow path A2 of the second stage, the cross-sectional areas may not be different from each other and may be the same.

In the vertical flow paths 270, the lengths of the small-diameter flow paths D1 are gradually increased from the vertical flow path 270 in which the distance from the introduction flow path 280 connected to the distribution flow path 250 to the vertical flow path 270 is relatively long to the vertical flow path 270 in which the distance is relatively short. Furthermore, the lengths of the large-diameter flow paths D2 are gradually reduced from the vertical flow path 270 in which the distance is relatively long to the vertical flow path 270 in which the distance is relatively short. However, it is not necessary for all of the vertical flow paths 270 to satisfy the relationship described above. In other words, at least two vertical flow paths 270 of two or more vertical flow paths 270 may satisfy the relationship described above. Preferably, among two or more vertical flow paths 270, a vertical flow path 270 in which the distance from the introduction flow path 280 connected to the distribution flow path 250 to the vertical flow path 270 is maximum and a vertical flow path 270 in which the distance is minimum may satisfy the relationship described above. However, when all of the vertical flow paths 270 satisfy the relationship described above, it is possible to further reduce variation in the pressure losses in the vertical flow paths 270.

The configuration of Embodiment 1 or Embodiment 2 may be used in alone. Alternatively, the configurations of Embodiments 1 and 2 may be used in combination.

In either configuration, it is possible to more effectively flow the air bubbles 403 to the lower side in the vertical direction, as long as the cross-sectional area of the vertical flow path 270 is smaller than that of the bifurcation flow path 260.

The first distribution flow path 251*a* is a flow path through which ink horizontally flows in a portion between the second flow-path member 220 and the third flow-path member 230. However, the configuration is not limited thereto. In other words, the first distribution flow path 251*a* may be a flow path inclined with respect to a Z plane. The first distribution flow path 251*b*, the second distribution flow path 252*a*, and the second distribution flow path 252*b* have a similar configuration.

Furthermore, the first vertical flow path 271*a* is perpendicular to the liquid ejection surface 20*a*. However, the configuration is not limited thereto. In other words, the first vertical flow path 271*a* may be inclined with respect to the liquid ejection surface 20*a*. The first vertical flow path 271*b*, the second vertical flow path 272*a*, and the second vertical flow path 272*b* have a similar configuration.

It is not necessary to set the Xa-direction width of the second opening 216 of the opening portion 201 in the flow-path member 200 to be smaller than that of the first opening 236. The second opening 216 and the first opening 236 may be openings of which the Xa-direction widths are substantially the same and which allow the rectangular-shaped COF substrate 98 to be accommodated therein. On the contrary, the Xa-direction width of the second opening 216 may be greater than that of the first opening 236.

The COF substrate 98 is provided as a flexible wiring substrate. However, a flexible print substrate (FPC) may be used as the COF substrate 98.

In Embodiment 1 or 2, the holding member 120 and the flow-path member 200 are fixed using, for example, an adhesive. However, the holding member 120 and the flow-path member 200 may be integrally formed. In other words, both the hold portion 121 and the leg portion 122 may be provided on the Z1 side of the flow-path member 200. Accordingly, the holding member 120 is not stacked in the Z direction, the Z-direction size of the flow-path member 200 can be reduced. Furthermore, since the hold portion 121 is provided in the flow-path member 200, the size of the flow-path member 200 in both the X direction and in the Y direction can be reduced because it is necessary for the flow-path member 200 to accommodate only a plurality of head main bodies 110 and it is not necessary for the flow-path member 200 to accommodate the relay substrate 140. Furthermore, a plurality of members are integrally formed, and thus the number of parts can be reduced. When the flow-path member 200 is constituted of the first flow-path member 210, the second flow-path member 220, and the third flow-path member 230, both the hold portion 121 and the leg portion 122 may be provided on the Z1 side of the third flow-path member 230.

In Embodiment 1 or 2, the Z direction is parallel to the vertical direction. However, without being limited thereto, the Z direction may be inclined with respect to, for example, the vertical direction.

In Embodiment 1, the head main bodies 110 are aligned in the Y direction and the plurality of head main bodies 110 constitutes the recording head 100. However, the recording head 100 may be constituted of one head main body 110. Furthermore, the number of the recording heads 100 provided in the head unit 101 is not limited. Two or more recording heads 100 may be mounted or one single recording head 100 may be mounted in the ink jet type recording apparatus 1.

The ink jet type recording apparatus 1 described above is a so-called line type recording apparatus in which the head unit 101 is fixed and only the recording sheet S is transported, in such a manner that printing is performed. However, the configuration is not limited thereto. The invention can be applied to a so-called serial type recording apparatus in which the head unit 101 and one or a plurality of recording heads 100 are mounted on a carriage, the head unit 101 or the recording head 100 move in a main scanning direction intersecting the transporting direction of the recording sheet S, and the recording sheet S is transported, in such a manner that printing is performed.

The invention is intended to be applied to a general liquid ejecting head unit. The invention can be applied to a liquid ejecting head unit which includes a recording head of, for example, an ink jet type recording head of various types used for an image recording apparatus, such as a printer, a coloring material ejecting head used to manufacture a color filter for a liquid crystal display or the like, an electrode material ejecting head used to form an electrode for an organic EL display, a field emission display (FED) or the like, or a bio-organic material ejecting head used to manufacture a biochip.

A wiring substrate of the invention is not intended to be applied to only a liquid ejecting head and can be applied to, for example, a certain electronic circuit.

What is claimed is:

1. A liquid ejecting head comprising:

a plurality of head main bodies, each of the plurality of head main bodies having a manifold path and nozzle openings for ejecting liquid from the manifold path; and a flow-path member having:

an inlet port that receives the liquid from a liquid supply source;

a mainstream path that is connected to the inlet port so as to receive the liquid from the inlet port;

a plurality of tributary paths that branch off from the mainstream path so as to receive the liquid from the mainstream path; and a plurality at outlet ports that are connected to the plurality of tributary paths so as to respectively supply the liquid to the plurality of head main bodies, wherein in each of the tributary paths, a cross-sectional area changes in a middle position thereof, and in the plurality of tributary paths, lengths from the plurality of outlet ports to positions where the cross-sectional areas change are different from each other.

2. The liquid ejecting head according to claim 1, wherein, in each of the plurality of tributary paths, a portion in which the cross-sectional area changes has a tapered shape.

3. The liquid ejecting head according to claim 1, wherein a wiring substrate connected to one of the plurality of head main bodies is provided between two adjacent tributary paths of the plurality of tributary paths.

4. The liquid ejecting head according to claim 1, wherein the plurality of outlet ports respectively connect to the plurality of head main bodies.

5. The liquid ejecting head according to claim 1, wherein the flow-path member includes a first flow-path member and a second flow-path member, the first flow-path member being stacked on the second flow-path member, the first flow-path member includes a first groove on a bottom side thereof, the second flow-path member includes a second groove on an upper side thereof facing the first groove of the first flow-path member, and the liquid flows in the first and second grooves.

6. The liquid ejecting head according to claim 5, wherein the positions where the cross-sectional areas change are formed in the second flow-path member.

7. The liquid ejecting head according to claim 6, wherein the flow-path member includes a third flow-path member, the second flow-path member being stacked on the third flow-path member, the second flow-path member includes a third groove on a bottom side thereof, the third flow-path member includes a fourth groove on an upper side thereof facing the third groove of the second flow-path member, and the liquid flows in the third and fourth grooves.

8. The liquid ejecting head according to claim 7, wherein diameters of the plurality of outlet ports are the same.

9. The liquid ejecting head according to claim 7, wherein a minimum value of the cross-sectional areas of the plurality of tributary paths is smaller than a value of a cross-section area of the mainstream portion path.

10. The liquid ejecting head according to claim 7, wherein a value of a diameter of each of the plurality of outlet ports is smaller than a maximum value of a cross-sectional area of the mainstream path, and the value of the cross-section area of each of the plurality of outlet ports is greater than a minimum value of the cross-sectional areas of the plurality of tributary paths.

11. A liquid ejecting apparatus comprising:

the liquid ejecting head according to claim 7.

12. The liquid ejecting head according to claim 5, wherein diameters of the plurality of outlet ports are the same.

13. The liquid ejecting head according to claim 5, wherein a minimum value of the cross-sectional areas of the plurality of tributary paths is smaller than a value of a cross-section area of the mainstream.

14. The liquid ejecting head according to claim 5, wherein a value of a diameter of each of the plurality of outlet ports is smaller than a maximum value of a cross-sectional area of the mainstream path, and the value of the cross-section area of each of the plurality of outlet ports is greater than a minimum value of the cross-sectional areas of the plurality of tributary paths.

15. A liquid ejecting apparatus comprising:

the liquid ejecting head according to claim 6.

16. The liquid ejecting head according to claim 1, wherein diameters of the plurality of outlet ports are the same.

17. The liquid ejecting head according to claim 1, wherein a minimum value of the cross-sectional areas of the plurality of tributary paths is smaller than a value of a cross-section area of the mainstream path.

18. The liquid ejecting head according to claim 1, wherein a value of diameter of each of the plurality of outlet ports is smaller than a maximum value of a cross-section area of the mainstream path, and the value of the cross-section area of each of the plurality of outlet ports is greater than a minimum value of the cross-sectional areas of the plurality of tributary paths.

19. A liquid ejecting apparatus comprising:

the liquid ejecting head according to claim 1.

* * * * *